US007384040B2

(12) United States Patent
Tunink et al.

(10) Patent No.: US 7,384,040 B2
(45) Date of Patent: Jun. 10, 2008

(54) MULTIPLE INSERT DELIVERY SYSTEMS AND METHODS

(75) Inventors: Corey Dean Tunink, Omaha, NE (US); Timothy J. Walpus, Omaha, NE (US); Jeffery G. Nowlin, Council Bluffs, IA (US); Jay E. Greene, III, Omaha, NE (US)

(73) Assignee: First Data Corporation, Greenwood Village, CO (US)

( * ) Notice: Subject to any disclaimer, the term of this patent is extended or adjusted under 35 U.S.C. 154(b) by 110 days.

(21) Appl. No.: 11/186,234

(22) Filed: Jul. 20, 2005

(65) Prior Publication Data

US 2005/0263953 A1 Dec. 1, 2005

Related U.S. Application Data

(60) Division of application No. 10/718,285, filed on Nov. 19, 2003, now Pat. No. 6,953,189, which is a continuation of application No. 10/147,180, filed on May 15, 2002, now Pat. No. 6,669,186, which is a continuation-in-part of application No. 09/828,585, filed on Apr. 5, 2001, now Pat. No. 6,679,489.

(60) Provisional application No. 60/215,507, filed on Jun. 30, 2000.

(51) Int. Cl.
*B65H 7/12* (2006.01)

(52) U.S. Cl. ..... 271/262; 271/265.04; 271/9.13; 271/259

(58) Field of Classification Search ..... 271/262, 271/258.01, 259, 265, 265.04; 270/52.06, 270/52.15

See application file for complete search history.

(56) References Cited

U.S. PATENT DOCUMENTS 5,836,580 A * 11/1998 Hansen et al. ..... 271/9.13
6,000,693 A * 12/1999 Tranquilla ..... 271/263
6,669,186 B2 * 12/2003 Tunink et al. ..... 271/9.11

FOREIGN PATENT DOCUMENTS

JP 05301657 A * 11/1993

OTHER PUBLICATIONS

English Translation of cited JP 05301657 A Patent.*

* cited by examiner

*Primary Examiner*—Kaitlin S Joerger
(74) *Attorney, Agent, or Firm*—Townsend and Townsend and Crew LLP

(57) ABSTRACT

A delivery system comprises a frame, and a plurality of hoppers attachable to the frame in a vertically spaced apart arrangement. The hoppers are each configured to hold a plurality of sheet-like materials. At least one upper belt is movably coupled to the frame, with the belt being configured to move the sheet-like materials downward from the hoppers. At least one contact roller is disposed below each hopper, and at least one suction apparatus that is associated with each hopper. A moving system is configured to move the suction apparatus toward and away from the hopper to grasp and remove one of the sheet-like materials from the hopper, and to move the removed sheet-like material downward until grabbed by the contact roller.

7 Claims, 25 Drawing Sheets

INSERT TOWER PERSPECTIVE VIEW

ROLLER AND AIR JET ASSEMBLY

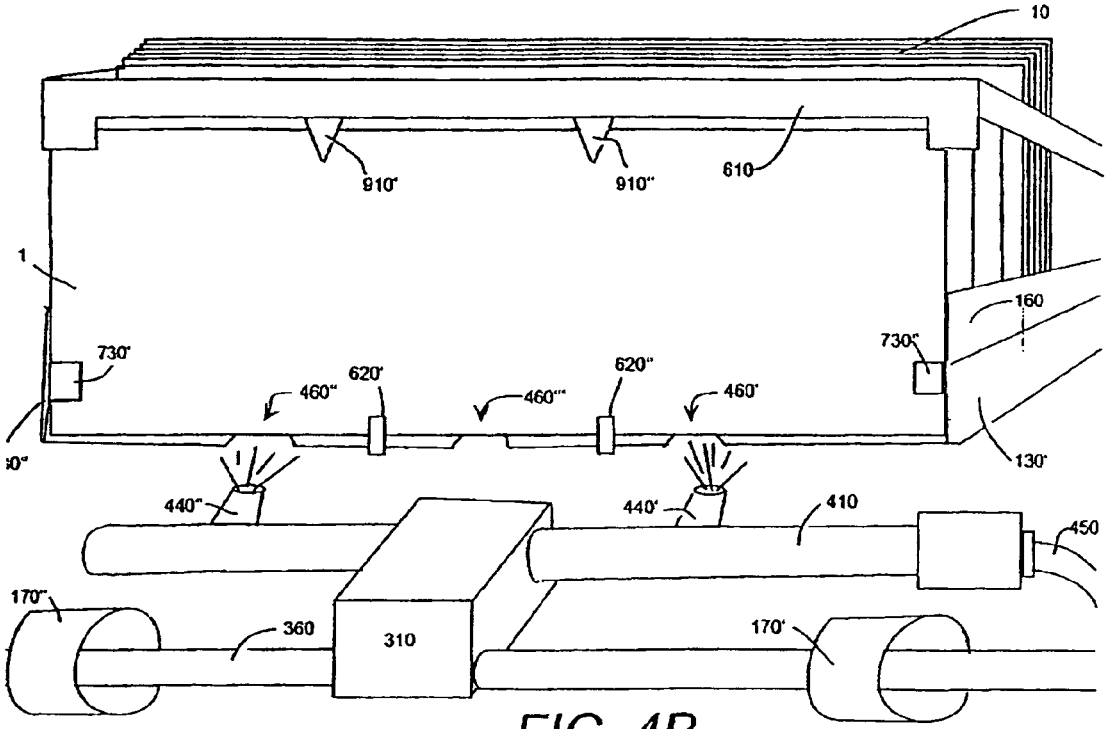
AIR JET FUNCTION FIG. 4B

AIR JET ASSEMBLY SIDE VIEW

FIG. 10A
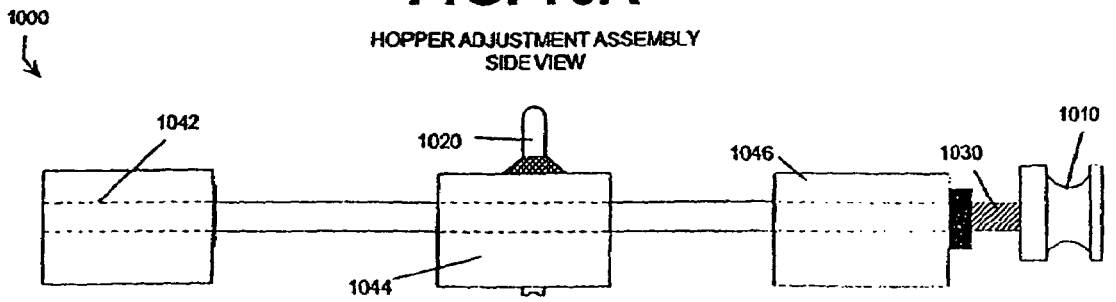
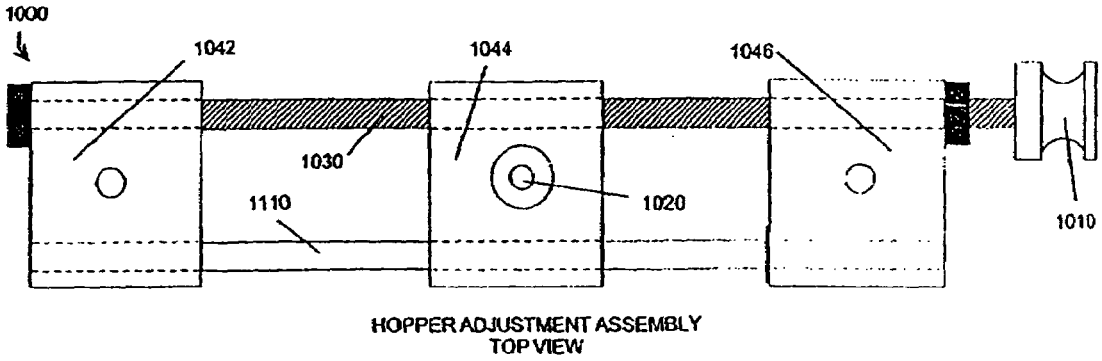
FIG. 10B

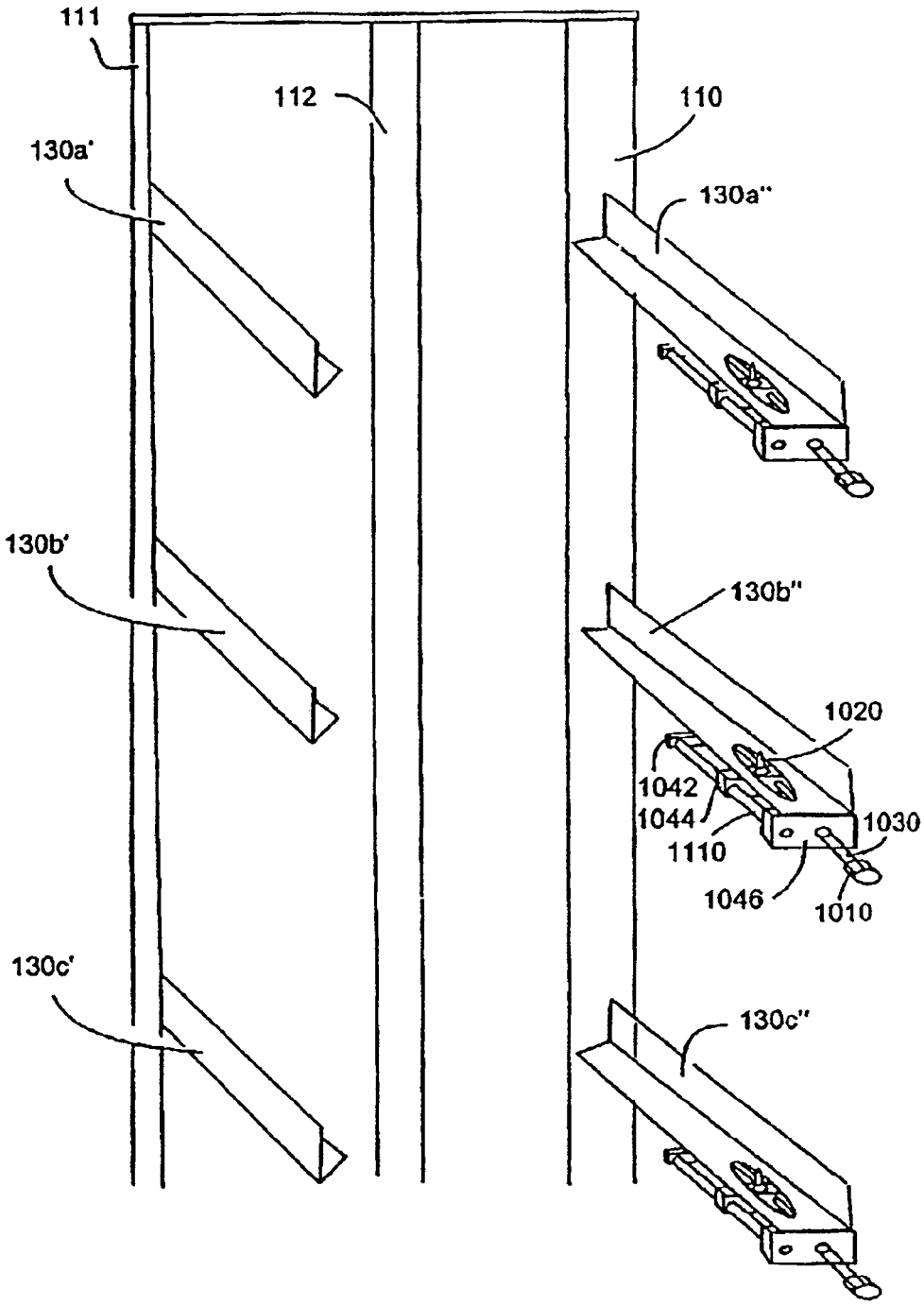
FIG. 11 TOWER WITH HOPPER ADJUSTMENT ASSEMBLY

MULTIPLE INSERT DELIVERY SYSTEMS AND METHODS

CROSS-REFERENCES TO RELATED APPLICATIONS

This application is a continuation in part application of U.S. application Ser. No. 09/828,585, filed Apr. 5, 2001, which is a continuation in part application and claims the benefit under 35 U.S.C. § 119 of U.S. Provisional Application No. 60/215,507 filed on Jun. 30, 2000 entitled Vertical Insert System and naming Fred Casto, Bruce Bennett, Mick McDonald, Jeff Schreiber, and Corey Tunink as inventors, the complete disclosures of which are herein incorporated by reference.

BACKGROUND OF THE INVENTION

Technical Field

The invention relates generally to processing of sheet-like material and, more particularly, to systems and methods that repeatedly provide requested vertically oriented sheet-like material from vertically aligned insert stations in an insert tower.

With the advent of the "Information Age," a vast amount of personal data has become available. Along with this information comes the opportunity to more specifically target people with offers designed to address their individual needs, activities, or desires. These targeted mailings have a much higher success rate for achieving a sale than non-targeted advertisements. Naturally, businesses are eager to capitalize on this opportunity. Hence, mailings to consumers have increasingly become more advanced by including more individually targeted offers. Consequently, the process for producing a mass mailing by a company has become significantly more complicated and burdensome.

Inclusion of targeted advertising pieces has dramatically increased the number of different inserts associated with a mass mailing. One classic scenario of a mass mailing includes a company sending bills to its customers. Typically, the bills are processed along a horizontal conveyor belt and ultimately stuffed in a mailing envelope. Insert stations are arranged in a row along the raceway. Each insert station has a vertical stack of horizontally oriented mail inserts. As the bill proceeds down the raceway, each designated insert is placed on top of the stack that includes the bill any prior inserts. Thus, as the number of different inserts increases, the foot-stamp of the raceway correspondingly increases to accommodate the increasing number of differing insert stations along the raceway.

The floor space required by the current demand for inclusion of multiple inserts has increased so dramatically that the current locations for processing mass mailings have become inadequate. Therefore, a need exists for a more efficient use of space for the insertion process. Additionally, not all inserts are appropriate for all customers. Targeted inserts necessitate that some customers receive certain inserts, while other customers should receive inserts more appropriate for their individual circumstances. Hence, more efficient insert stations arc required that are capable to, deliver to multiple people differing inserts.

New designs for insert stations also can create new technological obstacles. The shear numbers in today's mass mailings require optimization of every aspect of any new insert stations. Even small improvements can effect the speed and efficiency of the entire process. Consequently, any part of the insert process that can be enhanced produces significant dividends during the course of producing a mailing that includes numerous inserts.

The current design for insert stations has one vertical stack of horizontally oriented mail inserts. However, improved designs will include multiple stations capable of handling a plurality of differing inserts in the same approximate floor space. These multiple stations may include vertical towers.

Vertical stacks of horizontally oriented inserts in a vertical tower will necessitate several orientation changes from the pulling position at the insert station until delivery to the raceway. Reducing orientation changes not reduces the chance of jams, but can significantly enhance efficiency. Any enhancement in modern high speed operations can create a significant savings in the time required to complete a mailing.

As insert stations become complex, the need for an accurate determination that the system is working properly increases. A detection mechanism that can detect if an insert has been pulled is relatively simple. The detection mechanism only needs to detect the presence of an insert. However, detecting if more than insert has been pulled is more complicated.

Merely detecting the presence of an insert cannot provide enough information to determine if multiple inserts have been pulled. Therefore, a system needs to detect the number of inserts pulled. However, most inserts are relatively thin, and the deflection caused by a thin insert is typically too small to measure accurately. A mechanism that can amplify these small distances would greatly enhance the ability to accurately detect if multiple inserts have been pulled. Detection of pulling multiple inserts is important to ensure adequate inserts are available for the mailing, ensure that the postage on an individual piece of mail is sufficient, and to prevent a system shutdown when the insert stack prematurely empties.

Hence, an improved insert system is needed. This system needs to provide be able to deliver multiple inserts to differing people. In addition, the system needs to eliminate unwarranted orientation changes and can accurately detect if multiple inserts have been pulled.

BRIEF SUMMARY OF THE INVENTION

The present invention meets the needs described above by providing a multiple insert delivery system. The multiple insert delivery system conserves valuable floor space by utilizing vertical insert towers. Vertical insert towers include a plurality of insert hoppers arranged substantially vertically in the towers. The vertical arrangement of the insert hoppers allows for many more different inserts to be utilized by the system in the same floor space. Naturally, the greater number of different insert materials available allows for much more efficient targeting of consumers. Target specific materials naturally increase the effectiveness of the insert.

However, in today's mass marketing environment, every system needs to operate at peak efficiency. In a delivery system, the elimination of unnecessary changes in the flow path of the materials enhances efficiency. In order to conserve floor space, the transport mechanism with an insert tower transport should be vertically linear. Correspondingly, the insert material is aligned vertically when in the transport mechanism. Therefore, one embodiment of the present invention contemplates initially loading the insert material aligned vertically in the insert hoppers rather than the inserts lying horizontally in the hopper. The vertical alignment of the material in the hopper will eliminate one unnecessary paper direction change. Every direction change increases the probability of paper jams. Likewise, gradual direction changes decrease the probability of an insert jam. Therefore, the insert tower utilizes a multistage turn to rotate the material from a vertical alignment while in the transport mechanism to a near horizontal alignment when exiting the tower. Multistage turns greatly enhance the ability of less flexible materials to be able to make the directional transition.

A major concern of a multiple insert delivery system is the problem of pulling more than one insert from a hopper at a time. The present invention includes several features to minimize pulling multiple inserts. In one embodiment, the materials are loaded vertically into the insert hoppers forming a horizontal queue of vertically aligned inserts. A suction apparatus utilizing a vacuum accomplishes the actual pulling of an insert. The first sheet of the horizontal queue is loosened or separated from the queue by compressed air applied to the base area of the front sheet. This loosening assists the pulling mechanism with pulling only one insert. Additionally, resistance feet apply resistance to an insert when pulled. The lower the resistance feet are set, the less resistance the feet apply to an insert. Firm insert materials need less resistance when being pulled than flimsier material require. The resistance feet can be adjusted accordingly. Furthermore, the distance of the insert material from the pulling mechanism can be adjusted. The closer the suction cups of the suction apparatus are to the insert material, the greater the suction force asserted on the inserts by the vacuum. Therefore, altering this distance can assist the pulling mechanism with pulling a single insert.

In one efficiency-enhancing embodiment, the invention includes a method for detecting if the pulling mechanism grabbed multiple inserts. However, an insert may be as thin as a sheet of paper. An extender bar amplifies the apparent thickness of the insert materials pulled. This amplification enables easier and more accurate determinations of the number of inserts that were pulled from a given hopper.

Those skilled in the art can recognize that a vertical multiple insert tower has other applications than to provide insert materials to be stuffed into envelopes onto a conveyor belt. Any application where multiple differing materials are needed and the area of the foot stamp requires maximization of the space available can utilize the insert tower. Additionally, other mechanisms can be utilized to accomplish any of the described features.

Generally described, the invention is a system for repeatedly delivering sheet-like material to a transport system. The transport system delivers the predetermined sheet-like inserts for continued processing. The system pulls the sheet-like material from insert towers as desired. Insert towers contain multiple insert hoppers. The insert hoppers arc arranged vertically in the insert towers in order to conserve floor space.

Another efficiency enhancement is the vertical alignment of inserts when placed into the insert hoppers. Vertically aligned inserts create a horizontal queue of vertical sheet-like material. Pressure is applied to the rear of the horizontal queue to maintain the form of the queue. A mechanical push plate can be used to effectively apply the pressure to the rear of a horizontal queue. A pulling mechanism grabs the first insert. One effective pulling mechanism is a suction apparatus. A suction apparatus utilizes a vacuum to pull an insert. Removal of the pressure differential to the suction apparatus releases the sheet-like material. An air cylinder can be used to extend a suction cup associated with the suction apparatus to the insert material and retract the insert material to the transport mechanism of the insert tower.

A transport mechanism within a vertical insert tower includes a transport belt and a plurality of pinch rollers. The pinch rollers keep the inserts in constant contact with the transport belt. The transport belt delivers the insert material at a substantially constant rate. The movement of the inserts at a constant rate assists the system timing that ensures the process flows without difficulty. The transport mechanism moves the insert through the vertical section of the insert tower and delivers the insert to the delivery section of the tower. The delivery section changes the direction flow of the sheet-like material insert by a multistage turn. A two-stage turn can typically accomplish the objectives of the multistage turn. The first stage of the turn is accomplished by a set of belts that initially changes the direction flow. The second stage, another set of belts, completes the direction flow change from a vertical oriented flow to a near horizontal oriented flow. After the delivery section changes the direction flow from the vertical to horizontal orientation, the delivery section expels the inserts from the insert tower onto a transport system. The transport system delivers the inserts for further processing.

In most situations, only one insert per cycle should be pulled by any one pulling mechanism. Applying compressed air to the base of the first insert sheet of a queue helps separate the first sheet from the queue. Air jets can focus the air to the proper position at the base of the queue. The air jet can be aligned by the rotation of an air tube upon the insertion of an insert hopper. Additionally, a resistance applying foot can be adjusted to assist the pulling mechanism with grabbing only a single insert. The height of the resistance applying foot can be raised to increase the resistance of the material to being pulled from the queue. Conversely, the height can be lowered to facilitate the pulling of the insert. Inserts made of a flimsier, thinner material will need more resistance than a thicker, sturdier insert material.

Efficient operation of the system relies on ensuring the designed flow of the material. Detectors are utilized to determine if the inserts are being processed as desired. Detecting whether a suction apparatus succeeded in pulling sheet-like material is accomplished by miss detectors. Miss detectors can sense the presence of the insert material pulled by the pulling mechanism. Likewise, by sensing the continued presence of the insert material, a determination can be made whether the sheet-like material jammed upon discontinuation of the vacuum.

Another important determination is whether the pulling apparatus grabbed more than one insert. An optic sensor can measure the distance created by a swivel of a pivot arm as the insert passes between a front pinch roller and the transport belt. However, amplification of the created pivot arm swivel enhances the accuracy of the determination. Consequently, an extended pivot bar is utilized. The extended pivot bar is connected to the pivot arm. As the pivot arm swivels, one end of the extended pivot arm pivots a significantly greater amount due to the elongated distance created by the extended pivot bar from the pivot point. Upon an insert passing between the front pinch roller and the transport belt, an extremely accurate measurement can be made, using a light emitting sensor, of the distance between a fixed point on an insert apparatus and the elongated end of the extended pivoting bar. This measurement can be compared to a known pivot amount based upon the thickness of one insert. A significantly greater pivot value indicates that more than one insert has been pulled.

One method for repeatedly delivering sheet-like material to a transport system includes loading a plurality of sheet-like material vertically oriented into the insert hoppers. The insert hoppers apply pressure to the ends of the queues of vertically oriented sheet-like material. In order to assist the pulling mechanism with grabbing only a single insert, compressed air is applied to the first sheets of the queues of vertical sheet-like material. After the first sheet is loosened from the queue by the application of compressed air, the pulling mechanisms pull the first one of the sheets. The miss detectors sense whether the first sheets have been successfully pulled. A different detector senses whether a second sheet has been pulled when the first sheet was pulled from the selected hoppers. Finally, the inserts are delivered to the transport system. The transport system moves the inserts to another location for continued processing.

In another embodiment, the invention provides a delivery system that comprises a frame and a plurality of hoppers that are attachable to the frame in a vertically spaced part arrangement. Each of the hoppers is configured to hold a plurality of sheet-like materials. At least one upper belt is moveably coupled to the frame, with the belt being configured to move the sheet-like materials downward from the hoppers. Further, at least one contact roller is disposed below each hopper, and at least one suction apparatus is associated with each hopper. The system further includes a moving system to move the suction apparatus toward and away from the hopper to grasp and remove one of the sheet-like materials from the hopper, and to move the removed sheet-like material downward until grabbed by the roller. Hence, the sheet-like materials that are removed from each hopper remain in contact with the suction apparatus until moved downward and grabbed by the contact roller and the belt. In this way, the vertical spacing between the sheet-like materials may be maintained along the upper belt by ensuring a consistent spacing as each sheet-like material is removed from its respective hopper and placed into contact with the upper belt.

In one aspect, the moving system may be constructed of a cylinder that moves the suction apparatus toward and away from the hopper. The moving system may also include a linkage arrangement that is pivotally coupled to the frame member to move the suction apparatus in a generally up and down motion. Conveniently, a rod may be coupled to each linkage arrangement so that as the rod is moved up and down, each linkage arrangement is also simultaneously moved up and down.

In another aspect, a biasing roller may be spring biased against the contact roller. Advantageously, the biasing roller may be positioned on the back side of the upper belt. In this way, the spring used to bias the roller may be maintained away from the path of the sheet-like material so that wider sheet-like materials may be delivered using the system.

In another particular aspect, the suction apparatus may comprise a length of tubing and a suction cup that is coupled to the tubing. Optionally, a vacuum transducer may be used to sense the pressure within the suction apparatus to determine whether a sheet-like material has been attached to the suction apparatus. In a further aspect, a pair of upper belts may be employed, and the suction apparatus may include three suction cups that are located in between the two belts and on opposite sides of the two belts. The use of three suction cups helps to ensure that a sheet-like material will be grasped and removed from the hopper.

After the suction apparatus grasps a sheet-like material, the suction apparatus is moved backward so that the sheet-like material is removed from the hopper. To prevent the suction apparatus from moving too far backward, a guide may be pivotally coupled to the frame and may be used to stop backward movement of the suction apparatus. For example, the guide may include a roller that moves behind a block that in turn is coupled to the suction apparatus to stop backward motion and to guide the suction apparatus in its downward path.

Advantageously, an air jet may also be associated with each hopper. The air jets may be arranged to laterally supply air to the sheet-like materials to facilitate their separation.

To ensure that the sheet-like materials remain in contact with the upper belt as they are moved downward, a guide may be used to hold the sheet-like materials to the upper belt. The guide may conveniently comprise a spring biased roller and/or plate that forces the sheet-like material against the upper belt while still permitting the sheet-like material to move along the upper belt as it travels downward.

The delivery systems of the invention may also include a detection system to detect whether multiple sheets were simultaneously pulled from the same hopper. The detection system may comprise a roller that is disposed over one of the transport belts of the delivery system. Further, the roller may be coupled to an axial that is in turn pivotally coupled to the frame. Further, an arm extends from the axle and is in contact with a potentiometer. The roller moves relative to the belt when one or more sheet-like materials passes between the roller and the belt. In turn, the arm is pivoted about the axle. This movement is detected by the potentiometer that produces an electrical signal that is related to the amount of movement of the roller. Hence, the potentiometer may be calibrated to determine the number of sheet-like materials passing between the roller and the belt. Optionally, a trigger sensor may be configured to sense when a sheet-like material is beneath the roller. Upon receipt of a signal from the trigger sensor, the signal from the potentiometer may be evaluated to determine the number of sheet-like materials.

BRIEF DESCRIPTION OF THE DRAWINGS

FIG. 4B is a diagrammatic illustration of the air jet function.

FIG. 10A is a diagrammatic illustration depicting a side view of a hopper adjustment assembly.

FIG. 10B is a diagrammatic illustration depicting a top view of a hopper adjustment assembly.

FIG. 11 is a diagrammatic illustration depicting a tower with hopper adjustment assemblies.

DETAILED DESCRIPTION OF THE INVENTION

Figure 1A:
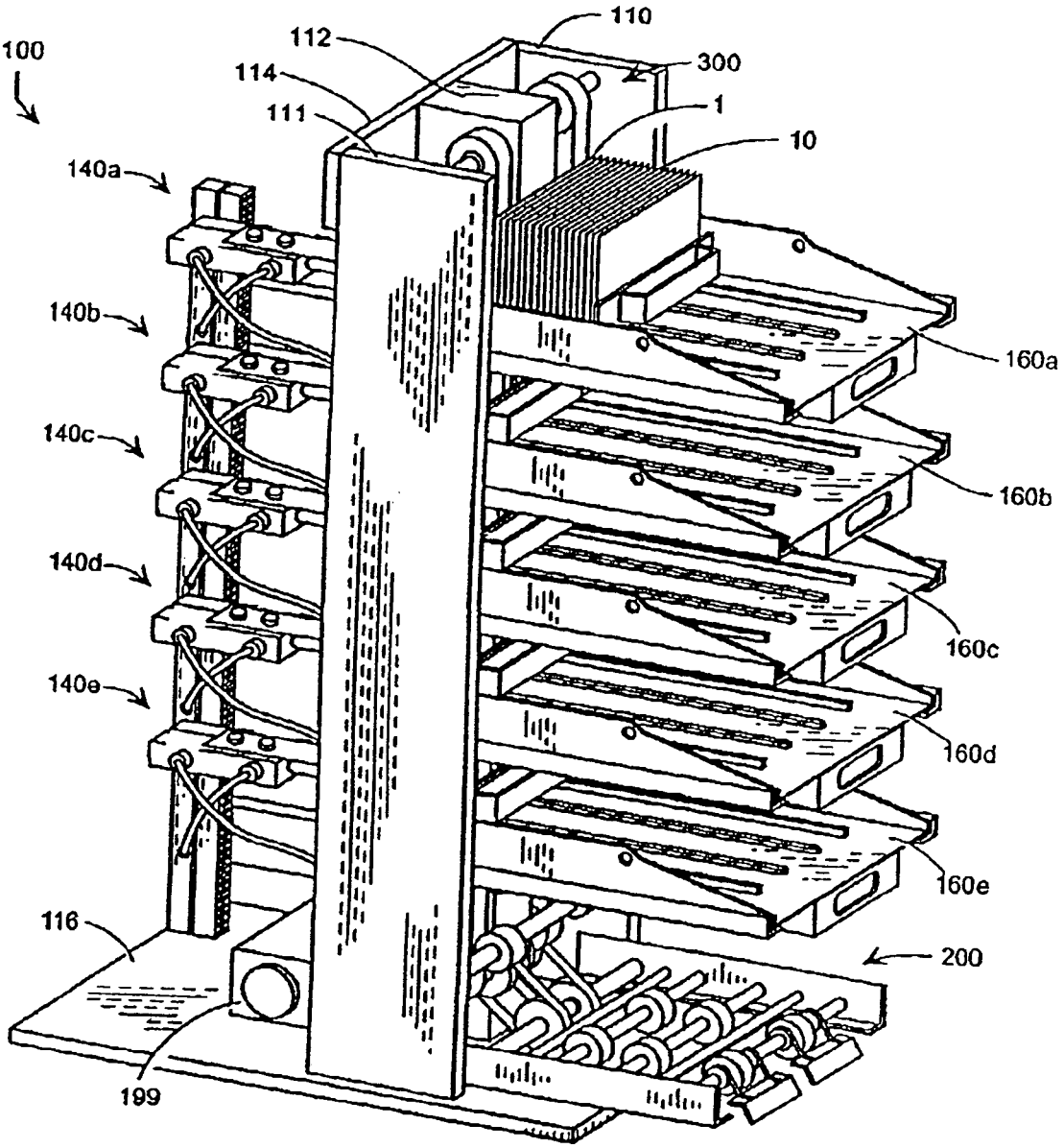
FIG. 1A is a diagrammatic illustration depicting a perspective view of an insert tower.

The multiple insert system is designed to provide a transport system with specified sheet-like material at a requested time. The system includes insert towers that provide the requested material at the appropriate time. Each insert tower contains multiple insert hoppers aligned vertically within the tower. Due to horizontal space constraints, the vertical arrangement of the hoppers enables the system to choose from significantly more different inserts than would be available from systems without vertical insert towers. Naturally, the insert hoppers are loaded with the inserts vertically oriented. Upon a request from a system computer, individually specified inserts are pulled from specified hoppers, and the insert tower delivers the inserts to a transport system. The transport system then moves the inserts to a different location for further processing.

Initially, bills that are to be sent to customers are processed. Typically, the bills are printed on continuous feed paper. The bills generally have a bar code that contains information indicating which inserts should be associated with that bill. A form cutter cuts the bills down to a size to fit into the mailing envelope. Each bill is delivered to a conveyor belt. As the bill traverses the conveyor, the selected appropriate inserts from each insert tower are added on top of the bill. At the end of the conveyor, the bill and the associated inserts are stuffed into an envelope for mailing.

The system computer controls the processing of the bills. The data contained in a bill's bar code informs the computer which inserts should be associated with that bill. As the bill passes in front of an insert tower, the computer sends a signal to that tower's programmable logic controller (PLC) informing the controller which inserts need to be pulled in that cycle for that insert tower. A PLC controls the relays and valves associated with an insert tower.

Because the system computer controls the insert processing, the system computer is also referred to as the inserter computer. Upon receipt of a signal from the inserter computer, the PLC activates the relays which enable the pulling of the specified individual inserts. A pulling mechanism pulls the inserts one at a time from the insert hopper. The inserts are vertically aligned when loaded into the insert hoppers. The vertical alignment of the inserts creates a horizontal queue of vertically aligned material. A push plate applies pressure to the rear of the queue to ensure the queue maintains its proper form. The insert hoppers include side guides that can be adjusted to accommodate differing widths of insert material. Likewise, the insert hoppers have an adjustable top guide to accommodate differing heights of insert material.

Vertically aligned insert material can be efficiently pulled by a suction apparatus mounted in the tower. The suction apparatus includes an air tube with a suction cup at one end. The other end of the air tube is attached to a vacuum generator. The vacuum enables the suction cup to successfully grab an insert. The extension of the air tube enables the suction cup to make contact with the first sheet of the queue. The air tube is connected to a cylinder rod. The cylinder rod extends and retracts the air tube. An air cylinder extends the cylinder rod when compressed air is applied to the air cylinder's extension chamber. As air is being added to the extension chamber, air is bled from the retraction chamber. Conversely, the cylinder rod is retracted upon compressed air entering the retraction chamber. Likewise, as air is being added to the retraction chamber, air is bled from the extension chamber. During the retraction of the cylinder rod, the air tube retracts and the insert approaches the tower's internal transport mechanism.

A miss sensor detector senses whether an insert has successfully been pulled. The miss detector typically includes a Light Emitting Diode (LED). The sensor detects the amount of light reflected by the close proximity of the insert. If the insert did not succeed in being pulled, the sensor will not detect significant reflection. Upon detection of a missed insert, the PLC sends a fault signal to the inserter computer.

Upon complete retraction of the cylinder rod, the vacuum to the air tube is terminated. The release of the vacuum causes the pulled insert to be let loose. The front pinch rollers force the insert to maintain contact with the tower transport belt. The transport belt delivers the insert at a relatively constant speed to the delivery section of the insert tower. The miss detector also senses whether the insert is still in the vicinity of the detector after it has been released. If the detector detects the presence of the insert material, a jam has occurred. Upon the detection of a jam, the PLC sends to the inserter computer a fault signal.

A double detection sensor detects whether the pulling mechanism pulled more than a single insert. The double detection sensor measures the degree of a swivel of the pivot arm caused by the passing of the insert material between the front pinch rollers and the transport belt. The pivot arm will swivel further if more than one insert passes between the roller and the transport belt. Each pivot arm is rigidly connected to a right pivot hand and a left pivot hand. The pivot hands are connected to the sides of the tower in any manner that allow the pivot hands to swivel. The points around which the pivot hands rotate are the connections to the insert tower. Consequently, the points around which the pivot arm must correspondingly pivot are also the same connection points. The other end from the connection to the tower of the left pivot hand is elongated. Upon a swivel of the pivot arm, this elongation amplifies the rotation caused by the swivel. Because the rotation of the pivot hand is greatly amplified, the double detection sensor can accurately determine if more than one insert has been pulled by a pulling mechanism.

The delivery section changes the direction of the insert material flow from a vertically aligned flow to a nearly horizontally aligned flow path. The delivery section has a first set of belts at the base of the transport belt. The first set of belts, the O-ring belts, change the flow path by approximately forty-five degrees (45°). The second set of belts, the delivery belts, complete the direction change of the material flow. Pinch rollers on the belts in the delivery section ensure that the inserts maintain constant contact with the belts. The delivery belt also expels the inserts from the insert tower onto the transport system. The transport system conveys the inserts to the next stage of the insert process.

Turning to the figures, in which like numerals indicate like elements throughout the several figures, FIG. 1A depicts a perspective view of an embodiment an insert tower 100. The operation of the insert tower is disclosed in greater detail in reference to the figures that follow:

The insert tower 100 is framed by a right side 110 and a left side 112. These sides are supported by a bottom plate 116 and a cross plate 114 at the top of the mechanism. A center support 112 provides structural support down the center of the insert tower 100. The center support 112 provides structural support for the pulling mechanisms 140 and the vertical transport mechanism 300. The vertical transport mechanism 300 is shown in greater detail in reference to FIG. 3. A transport motor 199 provides the impetus needed to transport pulled inserts throughout the insert tower 100. The transport motor is described in greater detail in reference to FIG. 2.

The illustrated insert tower 100 has five vertically aligned insert hoppers 160*a*-160*e*. The illustrated top insert hopper 160*a* contains vertically oriented inserts 10. Each insert hopper 160*a*-160*e* has a corresponding pulling mechanism 140*a*-140*e*. The pulling mechanisms 140 are described in greater detail in reference to FIG. 1B. The illustrated selected pulling mechanism 140*a* grabs the first insert 1 from the stack of vertically oriented inserts 10. After grabbing the first insert 1, the pulling mechanism pulls the first insert 1 to the vertical transport mechanism 300.

The vertical transport mechanism 300 transports the first insert 1 down the length of the insert tower 100 to the delivery system 200. The delivery system is described in greater detail in reference to FIG. 2. The delivery system 200 delivers the insert 1 to a horizontal transport system (not illustrated in FIG. 1A) for further processing. The horizontal transport system 1500 is disclosed in greater detail in reference to FIG. 15.

Figure 1B:
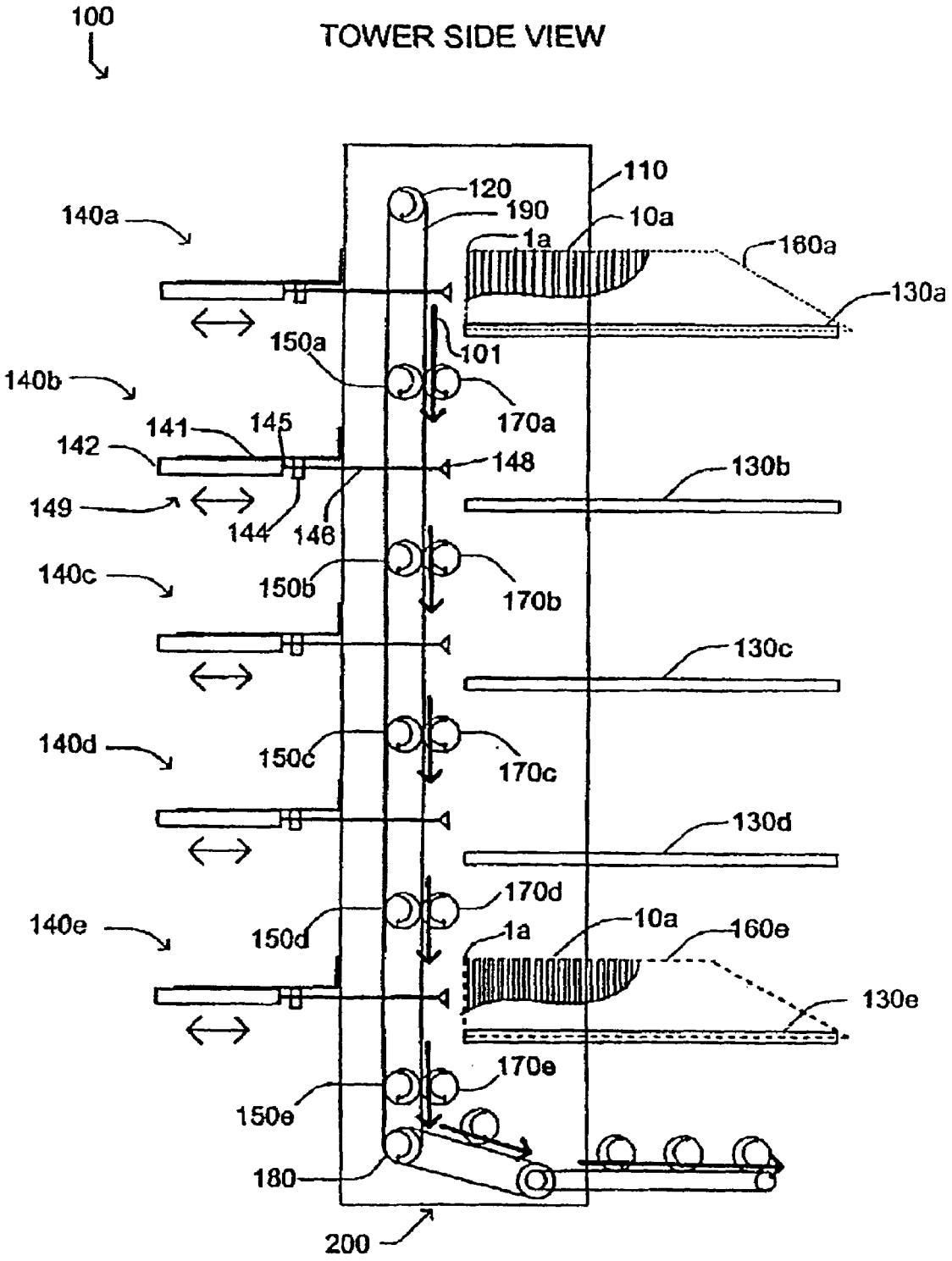
FIG. 1B is a diagrammatic illustration depicting a side view of an insert tower.

FIG. 1B depicts a side view of an embodiment of an insert tower 100. The insert tower 100 has a right side 110. The left side is not shown in order to expose the inner workings of an insert tower 100. The illustrated tower 100 has the capability to hold five different inserts. The different sheet-like inserts 10 are held in separate insert hoppers 160. Illustrated in phantom in reference to hoppers 160*a*, 160*e* is two different stacks of vertically oriented sheet-like inserts 10*a*, 10*e*. The paper path 101 traveled by the inserts 10 through the insert tower 100 is represented by direction arrows.

The five insert hoppers 160 ride on five corresponding vertically juxtaposed guide rails 130*a*-130*e*. Each of the five insert hopper positions have a corresponding pulling mechanism 140*a*-140*e* to pull the sheet-like materials for delivery to the exit of the tower. Each pulling mechanism 140 comprises an air cylinder bracket 141 and a suction apparatus 149. The air cylinder bracket 141 is attached to the center support 112 of the tower 100. The center support 112 of the tower 100 is described in reference to FIG. 3. The air cylinder bracket 141 supports a suction apparatus 149. The suction apparatus 149 includes an air cylinder 142, a vacuum tube mount 144, a cylinder rod 145, and a vacuum tube 146 with a suction cup 148. The air cylinder 142 provides the mechanism to move a cylinder rod 145 both towards the inserts and back to the vertical transport mechanism 300. The vertical transport mechanism 300 is described in greater detail in reference to FIG. 3. The cylinder rod 145 is attached to the air tube mount 144. The air tube mount 144 supports the air tube 146. The air tube 146 is hollow and provides a mechanism to support suction cup 148. A vacuum tube (not illustrated) is attached to one end of the air tube 146, and the suction cup 148 is attached to the opposite end. As the cylinder rod 145 moves towards the inserts 10, the air tube 146 advances into close proximity with the inserts 10. The suction cup 148 attached to the air tube 146 actually contacts the first insert sheet 1. When the cylinder rod 145 is retracted, the air tube 146 connected to the cylinder rod 145 retreats to just behind the transport belt 190. Naturally, the suction cups 148 are capable of grabbing the first insert 1 and then releasing the insert 1 upon vertical transport mechanism 300. The vertical transport mechanism 300 transports the inserts downward through the transport tower 100 upon the release of the vacuum to the delivery section 200. The vertical transport mechanism 300 includes a transport belt 190 that guides the inserts downward to the delivery section 200.

The front pinch rollers 170*a*-170*e* push the insert materials against the transport belt 190, which provides a substantially constant rate of downward motion. The front pinch rollers 170 are mounted on pivoting arms that will give under the pressure asserted by the insert material passing between the front pinch rollers 170*a*-170*e* and the transport belt 190. The pivoting action of each pivoting arm is illustrated in greater detail in FIG. 3. The rear pinch rollers 150*a*-150*e* are mounted on non-movable shafts to ensure the belt does not deflect as the material passes between the front pinch rollers 170*a*-170*e* and the rear roller 150*a*-150*c*. The transport belt drive roller 180 operates to run the belt 190 in conjunction with the top roller pulley 120. The drive shaft that rotates the transport belt drive roller 180 is illustrated in FIG. 2, which is an expansion side view of a delivery section 200.

Figure 2:
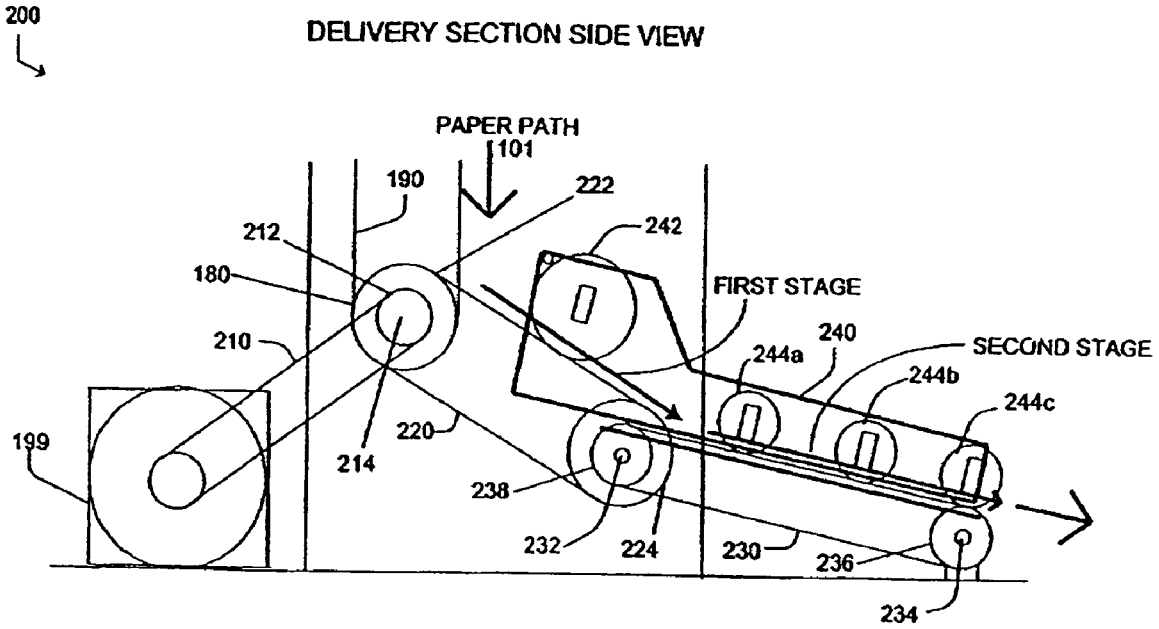
FIG. 2 is a diagrammatic illustration depicting a side view of a delivery section of an insert tower.

FIG. 2 depicts a side view of a delivery section 200 of an insert tower 100. The delivery section 200 includes a multiple stage turn assembly to turn the insert from a substantially vertical orientation to a substantially horizontal orientation. In an illustrated two-stage turn, the paper path 101 changes direction from a substantially vertical direction to a substantially horizontal direction in two-stages to assist stiffer inserts in making the turn. In a two-stage turn embodiment as illustrated, two separate sets of belts 220, 230 are utilized to accomplish the turn.

A transport motor 199 provides the drive to turn the belts 190, 210, 220, 230 in the transport and delivery process. The drive belt 210 is coupled to the drive pulley 212, which rotates the drive shaft 214 to power the belts 190, 220, 230. The transport belt drive roller 180, which is connected to the drive shaft 214, provides the rotation to operate the transport belt 190. The first stage of the two-turn stage is accomplished by the O-ring belt 220. The drive shaft 214 turns a rear O-ring pulley 222. The rear O-ring pulley 222 is coupled to a front O-ring pulley 224 that turns a delivery belt rear shaft 232. The delivery belt rear shaft 232 turns a rear delivery belt roller 238. The rear delivery belt roller 238 is coupled to a delivery belt crown roller 236 in order to rotate a delivery belt 230. The delivery belt 230 accomplishes a second stage of a two-stage turn and delivers the inserts 1 out of the vertical insert tower 100.

As previously discussed, the paper path 101 of the insert traverses the vertical transport mechanism as described in FIG. 1B and then enters the multiple stage delivery section 200. The O-ring belt 220 provides the first stage of the two-stage turn. A rear exit roller 242 pushes the insert material against the O-ring belt 220 to ensure a controlled transition to the second stage of the turn. The exit rollers 244*a*-244*c* provide the force utilized to push the insert material against the delivery belt 230. The constant contact of the inserts with the various belts provides the uniform speed needed to control the timing in order to deliver the inserts at an appropriate time onto a horizontal transport system illustrated in reference to FIG. 15.

Figure 3:
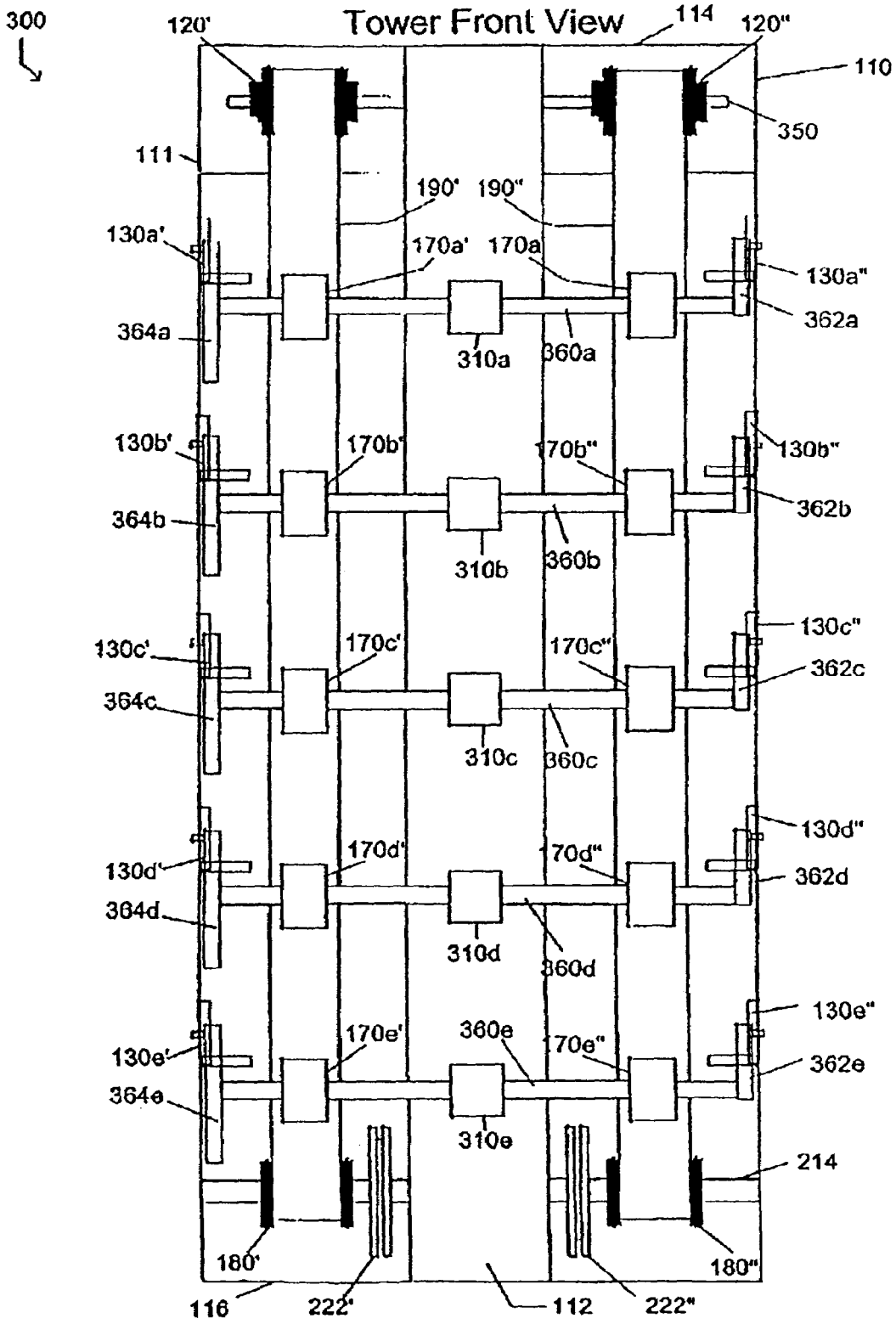
FIG. 3 is a diagrammatic illustration depicting a front view of an insert tower.

FIG. 3 depicts a front view of an insert tower illustrating the vertical transport mechanism 300. The left-guide rails 130*a*'-130*e*' and the right guide rails 130*a*"-130*e*" provide the rails that guide the five insert hoppers into proper alignment. The insert hoppers hold the insert material that the vertical transport mechanism 300 will provide to the delivery section 200 as illustrated in FIG. 2.

The vertical transport mechanism 300 delivers the inserts 1 via the transport belt 190. The transport belt 190 comprises a left transport belt 190' and a right transport belt 190" that rotate as a unit. The left transport belt 190' is coupled to a left top roller pulley 120' and a left transport belt drive roller 180'. Likewise, the right transport belt 190" is coupled to a right top roller pulley 120" and the right transport belt drive roller 180". The left 120' and right 120" top roller pulleys are both connected to a top roller shaft 350. The left 180' and right 180" transport belt drive rollers are connected to a drive shaft 214. The drive shaft 214 provides the impetus that rotates the transport belt 190. The left O-ring pulley 222' and right O-ring pulley 222" are also connected to the drive shaft 214. The O-ring pulleys 222 drive the O-ring belt 220, which provides the first stage of the delivery section 200 as illustrated in reference to FIG. 2.

The front pinch rollers 170*a*-170*e* push the insert material against the transport belt 190 in order to control the flow of the insert material to the delivery section 200. Thus, the let pinch rollers 170*a*'-170*e*' hold the insert material 1 against the left transport belt 190', and the right pinch rollers 170*a*"-170*e*" hold the insert material 1 against the right transport belt 190". Naturally, inserts from the top insert hopper 160*a* must pass between the each set of front pinch rollers 170*a*-170*e* and the transport belt 190, from the top set of front pinch rollers 170*a* to the bottom set of front pinch rollers 170*e*, on its way to the delivery section 200. Conversely, inserts from the bottom hopper 160*e* must only pass between the bottom set of front pinch rollers 170*e* and the transport belt 190 before entering the delivery section 200. As the insert material 1 passes between the front pinch rollers 170*a* and the transport belt 190, the corresponding pivot arm 360 swivels to allow the material adequate room to proceed downwards. For example, as insert material 1*a* from the top hopper 160*a* passes between the top front pinch rollers 170*a* and the transport belt 190, the top pivot arm 360*a* swivels to allow the passage of the insert material 1*a*. The top swivel arm 360*a* is connected to the top left pivot hand 364*a* and the top right pivot hand 362*a*. The left 364*a* and the right 362*a* pivot hands are connected to the sides 110 in any manner that enables the hands 362, 364 to pivot. Likewise, each lower pivot arm 360*b*-360*e* is coupled to the corresponding left 364*b*-364*e* and right 362*b*-362*e* pivot hands, which are connected to the sides 110 in a manner that enable the pivot arms 360 to swivel. The distance that a pivot arm 360 moves when material 1 passes a set of front pinch roller 170 is measured by a double detection sensor 1220. The double detection sensor 1220 is described in greater detail in FIG. 13. Additionally, each of the pivot arms 360*a*-360*e* supports a corresponding mounting block 310*a*-310*e*. Each mounting block 310*a*-310*e* provides the support for a roller and air jet assembly 400. Roller and air jet assemblies 400 are described in greater detail in FIG. 4.

The tower 100 front view also depicts the tower frame. The sides 110, 111 are supported by the plate bottom 116. On the other end, the sides 110, 111 are connected by a cross brace 114. A center support 112 provides the structural mechanism down the center of the tower as described in reference to FIG. 1B.

Figure 4A:
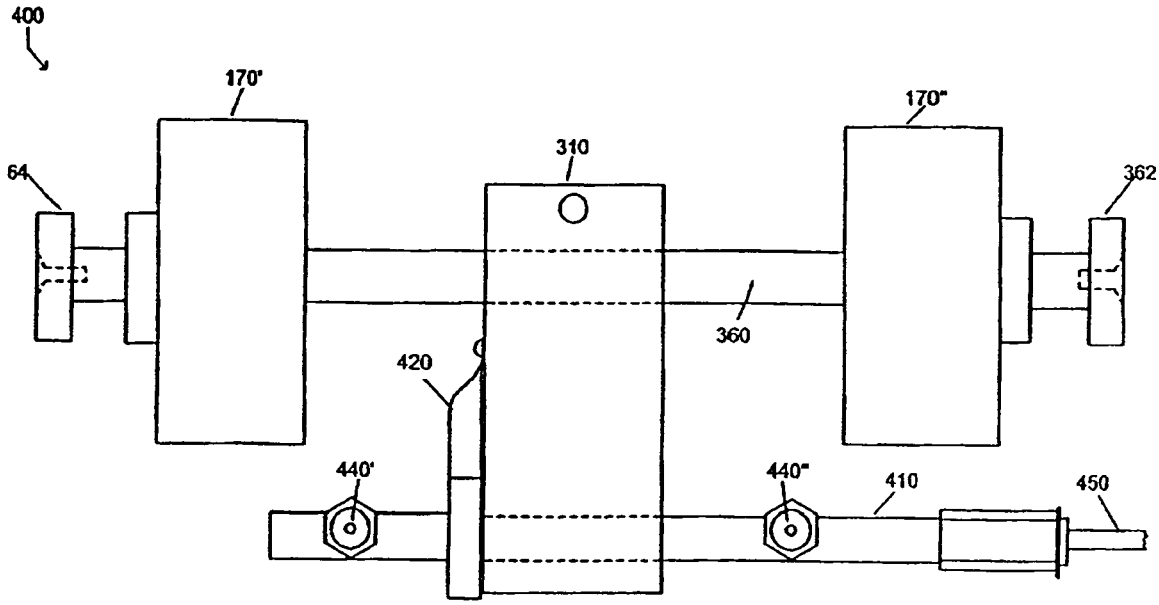
FIG. 4A is a diagrammatic illustration depicting a roller and air jet assembly.

FIG. 4A depicts a roller and air jet assembly 400. The left pivot hand 364 and the right pivot hand 362 connect to the tower sides 110, 111 in a manner that enables the pivot hands 362, 364 to swivel. The pivot arm and tower connections are described in greater detail in reference to FIG. 3. A pivot arm 360 is connected to the left pivot hand 364 and the right pivot hand 362. The pivot arm 360 swivels in response to insert material 1 exerting force on front pincher rollers 170 as the material traverses the vertical transport mechanism 300. A mounting block 310 is positioned midway between the left front pincher roller 170' and the right front pincher roller 170". The mounting block 310 supports an air jet assembly 500. Air jet assemblies 500 are described in further detail in FIG. 5. The air jet assembly has an air jet tube 410 supported by the mounting block 310. The air jet tube 410 connects a left air jet 440' and a right air jet 440" to an air jet tubing 450. The air jet tubing 450 is connected to an air supply (not illustrated). The left 440' and right 440" air jets blow air at the bottom of the front insert material riding in an insert hopper. The functions of the are jet are illustrated in greater detail in reference to FIG. 4B.

Each sheet of insert material is placed in the hopper vertically, which creates a horizontal queue of vertical insert material 10. The blown air helps loosen the first insert material 1. The loosening of the insert material assists the pulling mechanism with pulling only one insert. Naturally, the air jets need to provide the blown air to the bottom of the insert closest to the pulling mechanism. Hence, the air jets 440 need to be properly aligned to provide the blown air at the proper location.

The air jets 440 become aligned upon the insertion of an insert hopper into the tower. The alignment mechanism is described in greater detail in reference to FIG. 10. A tube alignment spring 420 applies outward tension to the air jet tube 410. As the insert hopper is inserted, the front push plate track support contacts the left 440' and right 440" air jets. This contact pushes against the tension supplied by the tube alignment spring 420. Upon complete insertion of the insert hopper, the air jet tube 410 rotates into proper alignment. Once properly aligned by the complete insertion of the insert hopper, the air jets 440 can provide the air that separates the foremost insert as the suction cups grab the insert.

FIG. 4B illustrates the functions of the air jets. The air jets 440 blast air at the bottom of the vertically oriented inserts 10. The air loosens the first insert 1 and the surround inserts from the vertically oriented inserts 10. The loosening of the initial inserts facilitates the pulling mechanism in grabbing just one insert. Indents 450 in the base of a hopper 160 enable the air to reach the base of the initial sheets of the vertically oriented inserts 10. The indents are described in greater detail in reference to FIG. 8. The hopper holds 160 the vertically oriented inserts 10. A upper hopper guide 610 supports the top of the vertically oriented inserts 10. The upper hopper guide 610 is described in greater detail in reference to FIG. 6. In addition, the left tooth 910' and the right tooth 910" of the upper support guide 610 provide the support for the top edge of the front insert 1. The base of the vertically oriented inserts 10 are supported by a left foot 730' and a right foot 730". The left and right feet 730 are described in greater detail in reference to FIG. 7. Support screws 610 supply resistance to the base of the vertically oriented inserts 10 as described in reference to FIG. 9. The hopper 160 rests on the left hopper guide 130' and the right hopper guide 130".

An air jet tubing 450 connects the air jet tube 410 to a compressed air supply (not illustrated). The air jet tube 410 is a hollow header that provides compressed air to the air jets 440. A mounting block 310 that connected to a pivot arm 360 supports the air jet tube. The mounting block 310 and pivot arm are described in greater detail in reference to FIG. 3.

Figure 5:
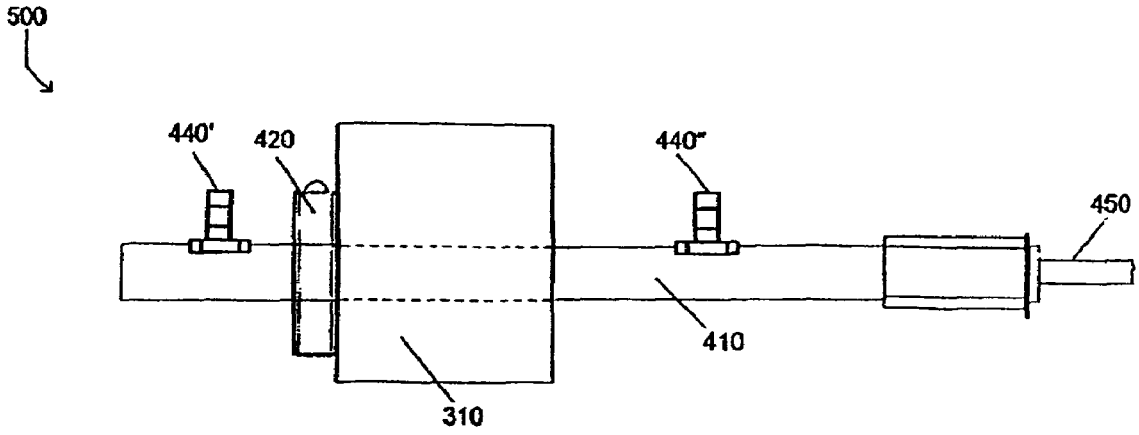
FIG. 5 is a diagrammatic illustration depicting an air jet assembly.

FIG. 5 depicts an air jet assembly front view 500. The mounting block 310 supports the air jet tube 410. Upon the insertion of an insert hopper into the tower 100, an the jet tube 410 rotates into a proper position as described in reference to FIG. 4. The left 440' and right 440" air jets when in proper position provide blown air that separates the foremost insert from the rest of the vertically aligned insert material. The air is supplied to the bottom of the foremost insert closest to the pulling mechanism. The air jet tubing 450 connects the air jet tube 410 with an air supply.

Figure 6:
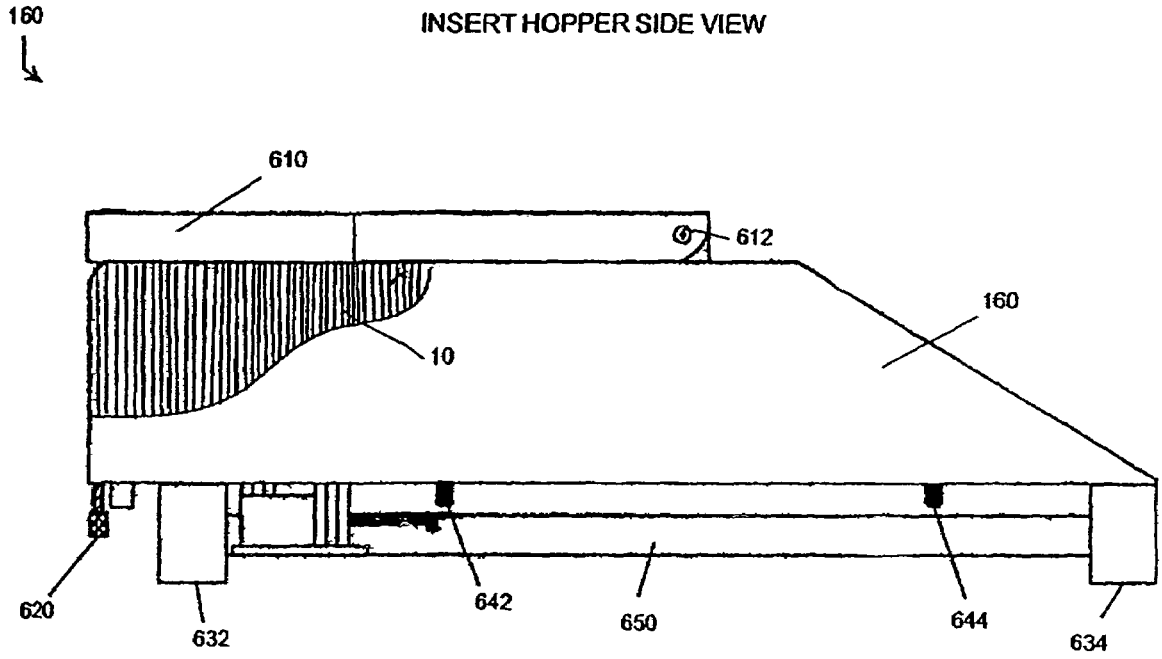
FIG. 6 is a diagrammatic illustration depicting a side view of an insert hopper.
Figure 9:
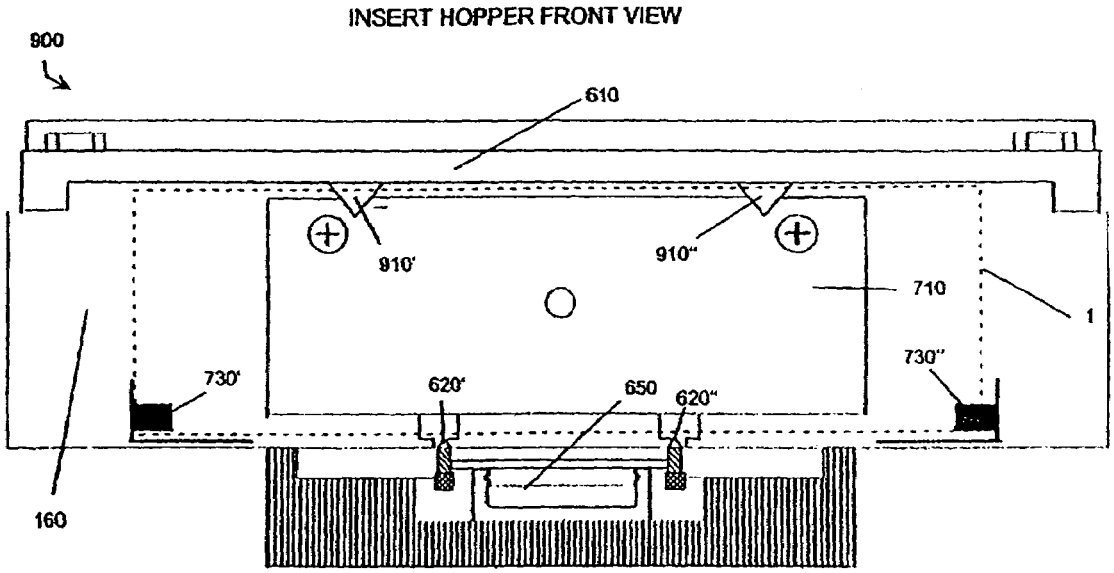
FIG. 9 is a diagrammatic illustration depicting a front view of an insert hopper.

FIG. 6 depicts an insert hopper 160 side view. The insert hopper 160 holds the vertical oriented insert material 10. The vertical inserts 10 create a horizontal queue when placed in an insert hopper 160. The insert hopper 160 is removable to allow easy refilling of the insert material. Naturally, the insert hopper 160 needs to be able to be adjusted for the different sizes of the insert material. An upper hopper guide 610 adjusts to accommodate varying heights of the inserts. An upper hopper guide screw 612 is loosened while adjust the height of the upper hopper guide 610. After adjusting, the upper hopper guide screw is tightened to keep the upper hopper guide 610 in proper position. The upper hopper guide 610 supports the teeth that provide the upper support for the insert material as illustrated in FIG. 9.

Figure 7:
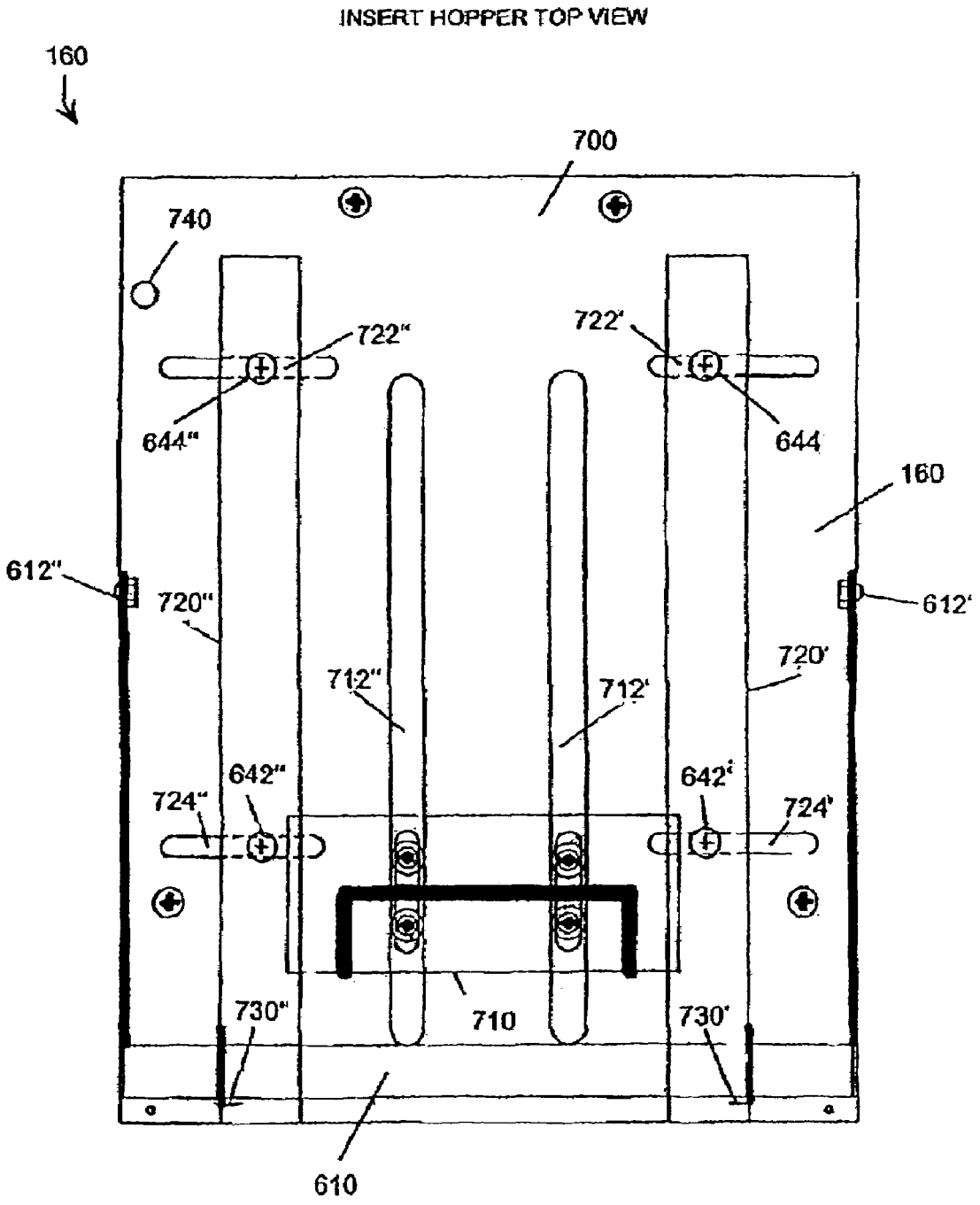
FIG. 7 is a diagrammatic illustration depicting a top view of an insert hopper.

In order to accommodate varying widths of inserts, the side guides 720 can be adjusted as further illustrated in FIG. 7. The front side guide screws 642 and the rear side guide screws 644 provide the mechanism to adjust the side guides. The side guide screws 642, 644 are loosed which allows for the side guides 720 to be adjusted to accommodate the width of the vertically oriented inserts 10. After adjusting, the side guide screws 642, 644 are tightened to keep the side guides 720 in place.

Furthermore, the support screws 620 can be raised or lowered to provide more or less resistance against the insert materials. The greater the resistance, the harder it will be for the pulling mechanism to remove inserts from the insert hopper 160. The support screws 620 are adjusted according the flexibility of the inserts so that the suction cups do not grab multiple inserts.

The push plate track 650 guides the push plate 710 as the push plate traverse the insert hopper 160. A front push plate track support 632 and a rear push plate track support 634 provide the structural support for the push plate track 650.

FIG. 7 depicts an insert hopper 160 top view. The top face 700 of the insert hopper 160 provides the support mechanisms for the vertically oriented insert material 10. The push plate 710 applies pressure to the rear of the horizontal queue of vertically oriented inserts 10. A left push plate guide track 712' and a right push plate guide track 712" provide the mechanism to attach the push plate 710 to the push plate guide. The push plate 710 applies substantially constant perpendicular pressure on the horizontal queue of vertically oriented inserts 10. The push plate 710 ensures the front piece of insert material 1 is in position to be grabbed by the pulling mechanism 140.

A front face of the first insert 1 needs support to counter the pressure applied by the push plate 710. The top part of the front face of the first insert 1 is supported by teeth 910 that are connected to the upper hopper guide 610 as illustrated in FIG. 9. The upper hopper guide 610 can be adjusted according to the height of the insert material. After adjusting, upper hopper guide screws 612 are tightened to keep the upper hopper guide 610 in position. The bottom of the first insert 1 is supported by the left foot 730' of the left side guide 720' and the right foot 730" of the right side guide 720". The left side guide 720' and the right side guide 720" can be adjusted to accommodate the width of the insert material. The left side guide 720' is adjusted by sliding the guide 720' to the appropriate width along the front left side guide track 724' and the rear left side guide track 722'. Once the left side guide 720' is in the appropriately aligned position, the front left side guide screw 642' and the rear left side guide screw 644' are fastened to fix the left side guide 720' into position. Likewise, the right side guide 720" is adjusted by sliding the guide 720" to the appropriate width along the front right side guide track 724" and the rear right side guide track 722". Once the right side guide 720" is in the appropriately aligned position, the front right side guide screw 642" and the rear right side guide screw 644" are fastened to fix the right side guide 720" into position. The various support features of the insert hopper 160 ensure that the vertically oriented inserts 10 remains adequately aligned until grabbed by the pulling mechanism 140.

An additional feature of the insert hopper 160 is the insertion limit mechanism 740. The insertion limit mechanism 740 is a hole in the hopper 160 that locks the insert hopper 160 into place by the activation of a spring loaded locking pin 1020 of the hopper adjustment assembly 1000. The hopper adjustment assembly 1000 is described in greater detail in reference to FIG. 10. The suction cups 148 of the pulling mechanism 140 traverse a set distance. The distance of first sheet 1 of vertically oriented inserts 10 from the fully extended suction cups 148 needs to be adjusted. The distance adjustment assists the suction apparatus 149 of the pulling mechanism 140 with grabbing just the first insert 1. If the fully extended suction apparatus 149 is too close to the vertically oriented insert materials 10, the suction cups 148 may grab multiple inserts. Conversely, if the suction apparatus 149 is too far from the materials, the suction cups 148 may not successfully grab a the first insert 1.

Figure 8:
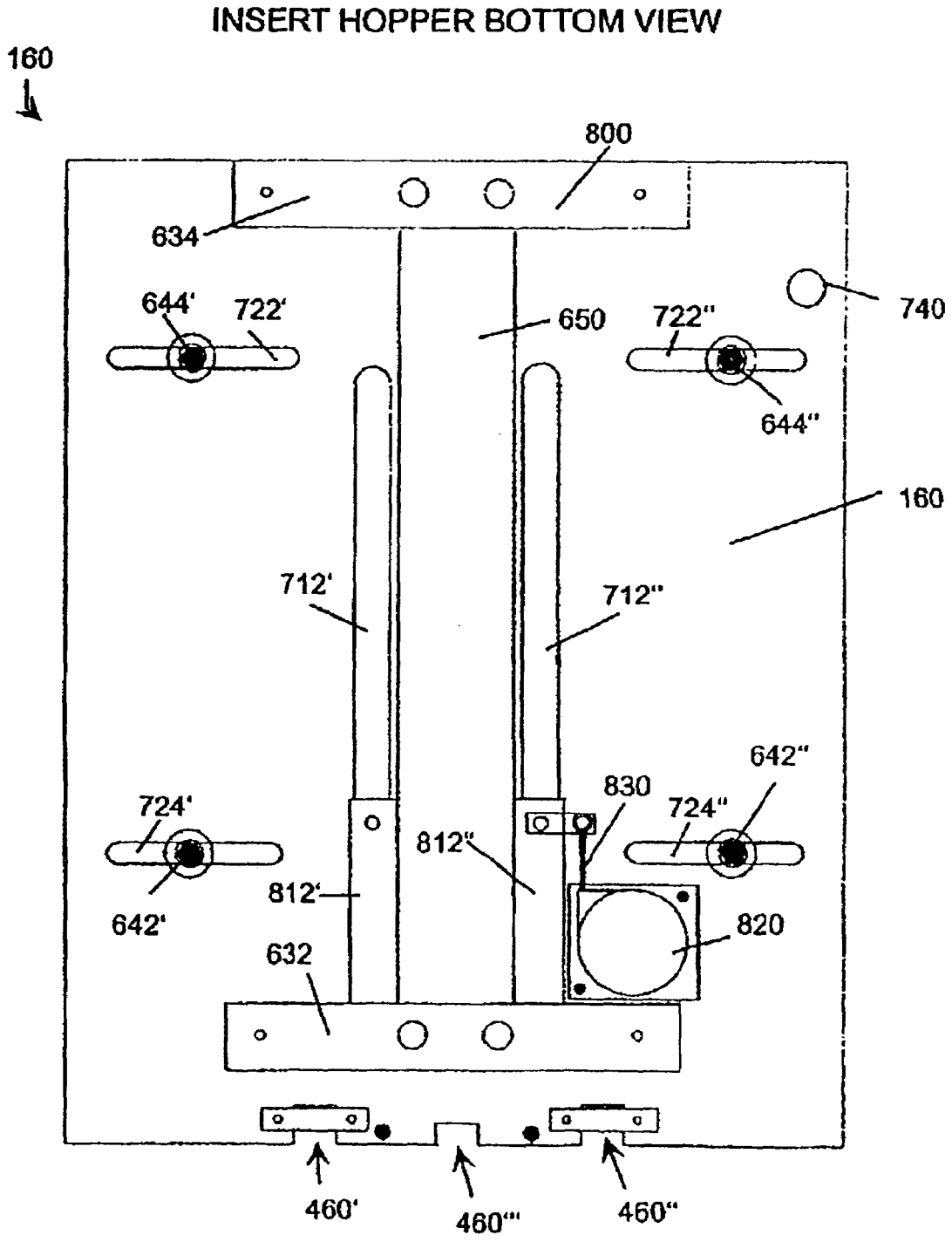
FIG. 8 is a diagrammatic illustration depicting a bottom view of an insert hopper.

FIG. 8 depicts a bottom view of an insert hopper 160. The insert hopper bottom 800 provides the mechanisms to secure the insert support features illustrated in FIG. 7, referenced above. The rear left side guide screw 644' and the front left side guide screw 642' fasten to lock in the position of the left side guide 720' at the appropriate position in the front left side guide track 724' and rear left side guide track 722". Likewise, the rear right side guide screw, 644' and the front right side guide screw 642" fasten to lock in the position of the right side guide 720" at the appropriate position in the front right side guide track 724" and rear right side guide track 722".

The push plate 710 provides the pressure to the rear of the horizontal queue of vertically oriented insert material 10 so that the front piece 1 of the vertically oriented insert material 10 is in a proper position to be grabbed by the pulling mechanism 140. The push plate 710 is connected to the left side 812' and the right side 812" of the push plate guide. The left push plate guide track 712' and the right push plate guide track 712" provide the mechanism that enables the push plate 710 to connect to the corresponding left side 812' and right side 812" of the push plate guide. A spring reel housing 820 contains a spring 830 that applies substantially constant pulling pressure for the push plate 710. The push plate spring 830 is coupled to the right side 812" of the push plate guide. The left side 812' and right side 812" of the push plate guide provide the mechanism for the push plate 710 to traverse along the push plate track 650. The push plate track 650 is supported by the front push plate track support 632 and the rear push plate track support 634.

An additional feature of the insert hopper 160 is the insertion limit mechanism 740. The insertion limit mechanism 740 is a hole in the hopper 160 locks the insert hopper 160 into place by the activation of a spring loaded locking pin 1020 described in FIG. 10. The suction cups 148 of the pulling mechanism 149 traverse a set distance. The distance of first sheet 1 of vertically oriented insert materials 10 from the fully extended suction apparatus 149 needs to be adjusted. The distance adjustment assists the suction apparatus 149 of the pulling mechanism 140 with grabbing just the first insert 1. If the fully extended suction apparatus 149 is too close to the vertically oriented insert materials 10, the suction apparatus 149 may grab multiple inserts. Conversely, if the suction apparatus 149 is too far from the materials 10, the suction cups 148 may not successfully grab a first insert 1.

The hopper 160 has indents 460 that allows compressed air blown from air jets 440 to loosen the initial inserts. When applied to the base of the first sheets of a queue of vertically oriented inserts 10, compressed air loosens these first sheets to assist the pulling apparatus 149 with grabbing only the first insert 1. The function of the indents 460 is illustrated in reference to FIG. 4B.

FIG. 9 depicts a front view of an insert hopper front view 160. The insert hopper 160 holds the vertically oriented insert material 10. The front view illustrates the mechanisms that hold the insert material 10 in place. A push plate 710 applies pressure to the rear of the horizontally queue of vertical insert material 10. The left foot 730' attached to the front of the left support guide 720' and the right foot 730" attached to the right support guide 720" support the bottom of the first insert 1 of the vertically oriented insert material 10. In addition, the left tooth 910' and the right tooth 910" of the upper support guide 610 provide the support for the top edge of the front insert 1 of vertically oriented insert material 10. Furthermore, the left support screw 620' and the right support screw 620" can be raised or lowered to provide more or less resistance against the insert materials 10. The greater the resistance, the harder it will be for the pulling mechanism to remove inserts from the insert hopper 160. More flexible materials will need more resistance to ensure that the pulling mechanism 140 will grab only one insert. Conversely, firmer materials will require less resistance in order for the pulling mechanism 140 to readily pull the insert. Therefore, the support screws 620 are adjusted according the flexibility of the vertically oriented inserts 10 so that the pulling mechanism 140 does not grab multiple inserts.

FIG. 10A depicts a hopper adjustment assembly 1000 side view. The hopper assembly 1000 installed in a tower 100 is illustrated in reference to FIG. 11. A hopper adjustment assembly 1000 is attached to each right hopper guide rail **1030*a*"-1030*e*". The spring loaded locking pin 1020 is activated by spring tension and is propelled into a hole in the insert hopper 160, the insertion limit mechanism 740. A knob 1010 turns a screw assembly 1030 that can adjust the position of the spring loaded locking pin's 1020 either closer to a pulling mechanism 140 or away from a pulling mechanism 140. The position of the spring loaded locking pin 1020 determines how far an insert hopper 160 can be inserted along the guide rails 130 before the insertion mechanism is reached 740. The deeper the insert hopper 160 is inserted, the closer the first insert 1 of the vertically oriented insert material 10 is to the fully extended position of the suction apparatus 149. The distance the first inert 1 of vertically oriented insert material 10 is from the fully extended position of the suction apparatus 149 determines how easily the pulling mechanism 140** can pull an insert.

FIG. 10B depicts a hopper adjustment assembly 1000 top view. A hopper adjustment assembly 1000 is attached to each right hopper guide rail 130". The spring loaded locking pin 1020 is activated by spring tension and is propelled into a hole in the insert hopper, the insertion limit mechanism 740. A knob 1010 turns a screw assembly 1030 that can adjust the spring loaded locking pin's 1020 position either closer to the pulling mechanism 140 or away from the pulling mechanism 140. The position of the spring loaded locking pin 1020 determines how far the insert hopper 160 can be inserted along the guide rails 130". The rear hopper adjustment block 1042 and the front hopper adjustment block 1046 provide the structural support to attach the hopper adjustment assembly 1000 to the right hopper guide rail 103". The hopper adjustment support bar 1110 provides structural support for the locking pin support block 1126 that ensures the spring loaded locking pin 1020 remains in an upright position.

FIG. 11 illustrates a hopper adjustment assembly 1000 connected to a right guide rail 1030' of an insert tower 100. The top three guide rails, **130*a*, 130*b*, 130*c*, are illustrated. Each left-guide rail 130' is connected to the left side wall 111 of the insert tower 100. Likewise, each right guide rail 130" is connected to the right side wall 110 of the insert tower 100. Each hopper adjustment assembly 1000** is identical.

A rear hopper adjustment block 1042 and a front hopper adjustment block 1046 connect the hopper adjustment assembly 1000 to the right guide rail 130". The hopper adjustment support bar 1110 provides the structural support for a locking pin support block 1044. The locking pin support block 1044 supports a spring loaded locking pin 1020.

An insert hopper 160 is inserted along the guide rails 130 until the spring loaded locking pin 1020 is activated. Spring tension activates the spring loaded locking pin 1020. The spring tension forces the spring loaded locking pin into the insert limit mechanism 740, a hole in the bottom of an insert hopper 160. A knob 1010 turns a screw assembly 1030 that adjusts the position of the spring loaded locking pin's 1020 either further into the tower 100 or away from away from the tower 100. The position of the spring loaded locking pin 1020 determines how far the insert hopper 160 can be inserted along the guide rails 130".

Figure 12:
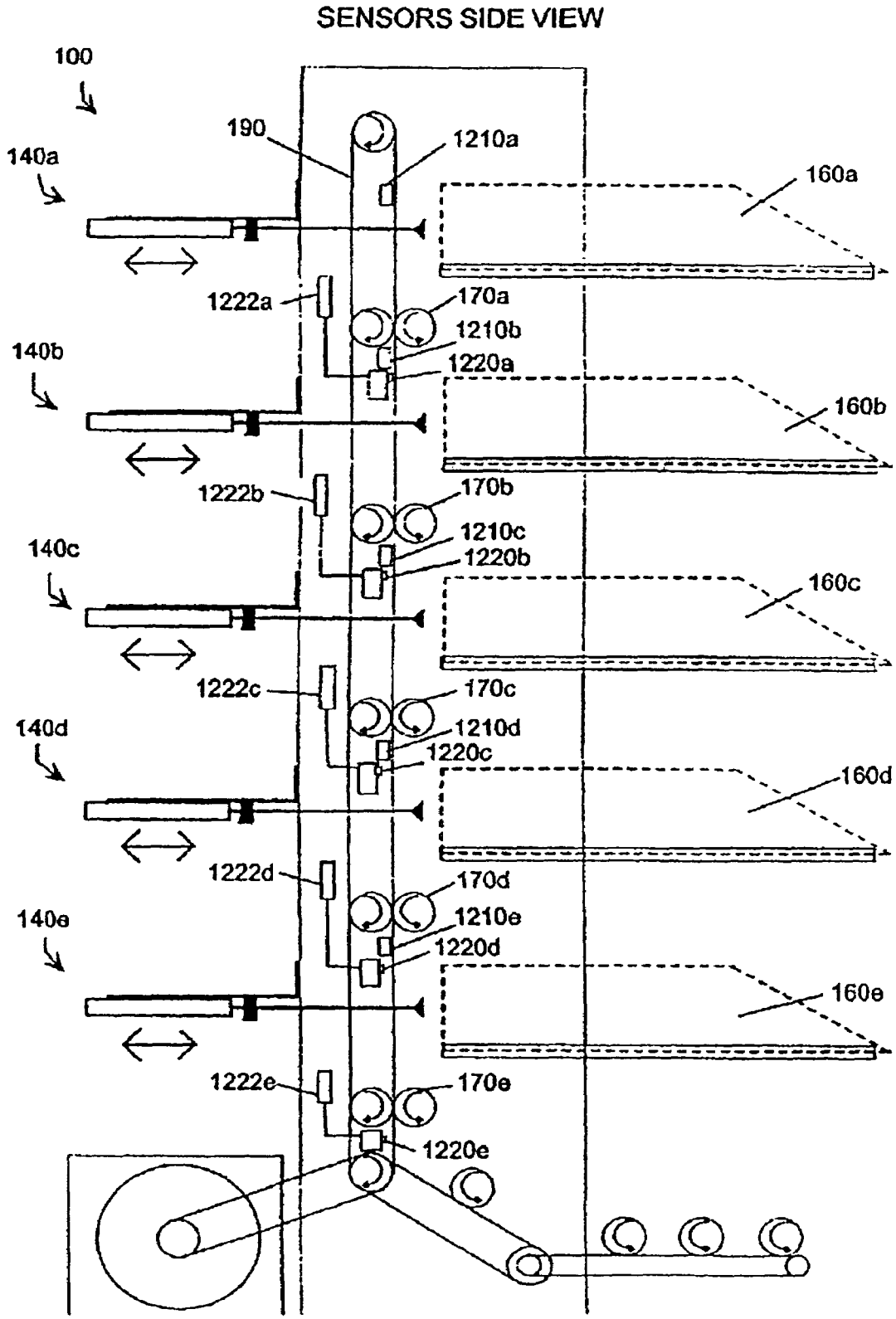
FIG. 12 is a diagrammatic illustration depicting a side view of a tower with detector sensors.

FIG. 12 depicts the locations of detector sensors 1210, 1220. Further description of the detailed operation of the detection sensors 1210, 1220 is provided in reference to FIG. 13. The illustrated insert tower 100 has five insert stations holding an insert hopper 160*a*-160*e*. An insert station includes an insert hopper 160 that holds vertically oriented insert material 10 and an insert pulling mechanism 140. Thus, the top insert pulling mechanism 140*a* grabs an insert from the top insert hopper 160*a* If the pulling mechanism 140*a* does not successfully grab an insert, the top miss detection sensor 1210*a* will not detect the material, and a programmable logic controller (PLC) will indicate a fault. If the pulling mechanism 140 successfully grabs an insert, the miss detection sensor 1210*a* will detect the material, and no fault signal will be generated. Upon reaching the transport belt 190, the top pulling mechanism 140*a* releases the insert. The insert the travels down the vertical transport mechanism 300 and passes by the top front pinch roller 170*a*. As the insert passes by the top front pinch roller 170*a*, the pivot arm associated with the top front pinch roller 170*a* swivels outward. The top double detection sensor 1220*a* measures the magnitude of the pivot as detailed in FIG. 13. The double detection sensor 1220*a* is connected by fiber optic cable to a fiber optic module 1222*a*. The fiber optic module 1222*a* converts the input provided by the double detection sensor 1220*a* into a digital signal and transmits it to the PLC. The PLC compares the transmitted signal to a known signal value equivalent to one insert. If the PLC determines that multiple inserts have been grabbed, the PLC sends a fault signal to the inserter computer.

Likewise, each lower pulling mechanism 140*b*-140*c* grabs an insert from its corresponding insert hopper 160*b*-160*e*. If a particular pulling mechanism 140*b*-140*e* does not successfully grab an insert, the corresponding miss detection sensor 1210*b*-1210*e* will not detect the material, and the programmable logic controller (PLC) will indicate a fault. If a pulling mechanism 140*b*-140*e* successfully grabs an insert, the corresponding miss detection sensor 140*b*-140*e* will detect the material, and no fault signal will be generated. Upon reaching the transport belt 190, each pulling mechanism 140*b*-140*e* releases the insert. Each insert then travels down the vertical transport mechanism 300 and passes by a respective first set of front pinch rollers 170*b*-170*e*. As the insert passes by the corresponding front pinch roller 170*b*-170*e*, the pivot arm associated with that particular front pinch roller 170*b*-170*e* swivels outward. The corresponding double detection sensor 1220*b*-1220*e* measures the magnitude of the pivot as detailed in FIG. 13. Each double detection sensor 1220*b*-1220*e* is connected by fiber optic cable to a respective fiber optic module 1222*b*-1222*e*. The particular fiber optic module 1222*b*-1222*e* converts the input provided by its double detection sensor 1220*b*-1220*e* into a digital signal. The PLC compares each transmitted signal to a known signal value equivalent to one insert. If the PLC determines that multiple inserts have been grabbed, the PLC sends a fault signal to the inserter computer, which causes the process to come to a stop.

Figure 13:
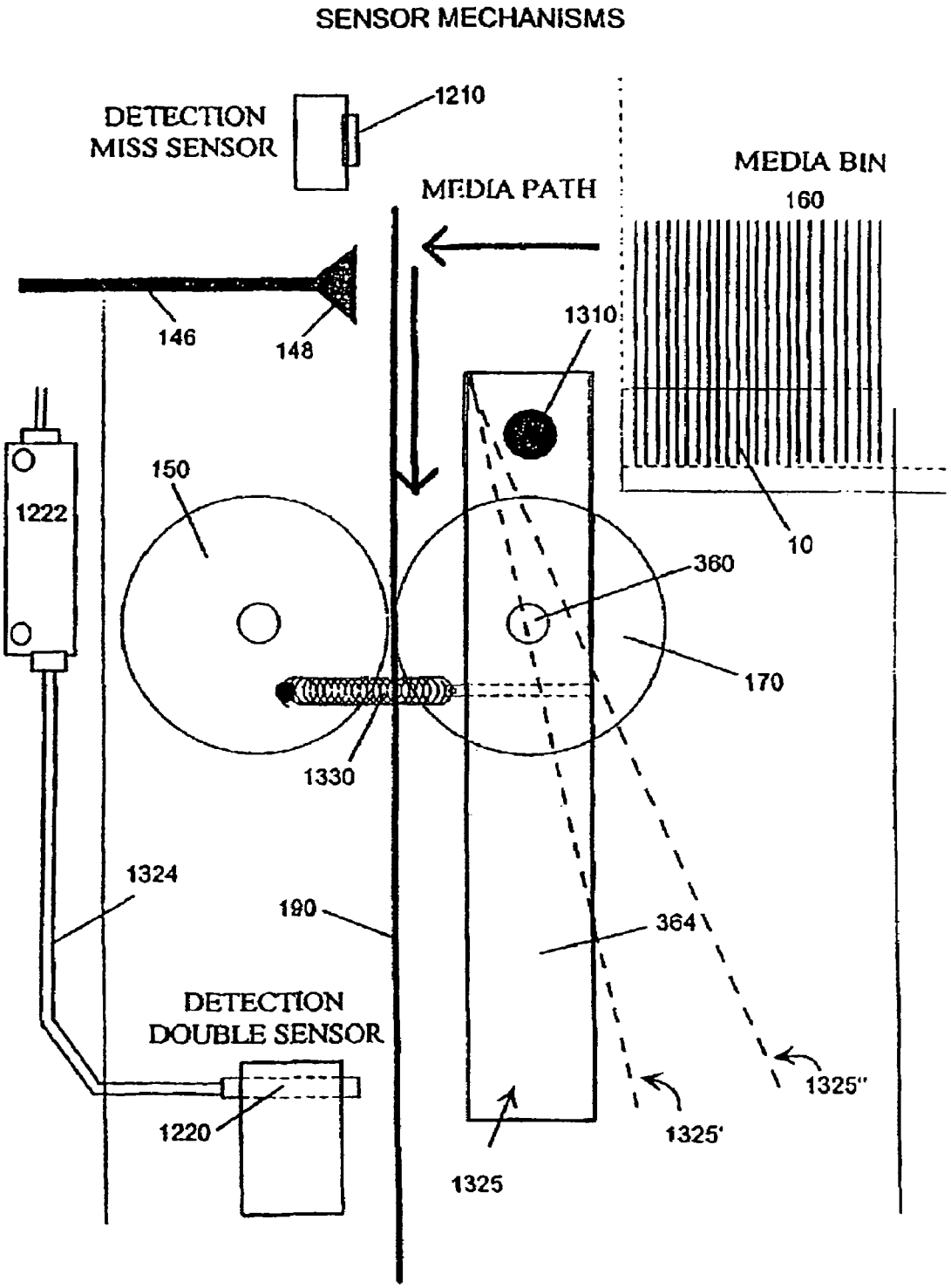
FIG. 13 is a diagrammatic illustration depicting insert sensor mechanisms.

FIG. 13 depicts the sensor mechanisms 1210, 1220. The sensors 1210, 1220 determine whether a problem has occurred in connection with the pulling of an insert. During the pulling of an insert, the miss detection sensor 1210 detects the presence of insert material. After the insert material is grabbed by the suction cup 148, the suction arm 146 retracts. The retraction of the suction arm 146 brings the insert into contact with the transport belt 190. When the insert nears the transport belt, the miss detection sensor 1210 tries to detect the presence of insert material. The miss detection sensor 1210 is a common Light Emitting Diode (LED) type sensor that is commercially available. The LED emits an infrared pulse and compares the returned pulse to background. If an insert has been pulled, the infrared pulse will be reflected and detected. If no insert has been pulled, the miss detection sensor 1210 will not detect the reflected pulse. If no pulse is detected, the miss detection sensor 1210 will indicate a miss. The PLC, in turn, will send a fault signal to the inserter computer, which will halt the insert operation.

Upon reaching the transport belt 190, the vacuum is released from the suction cup 148. Upon release of the vacuum, the transport belt 190 propels the insert into the front pinch rollers 170. The rear pinch roller 150 is stationary. Thus, the front pinch roller 170 must give way to provide adequate space for the insert to pass. The pinch roller spring 1330 provides the tension that ensures the front pinch roller 170 pivots no more than is needed to allow the insert material to pass. The front pinch roller 170 is connected to a pivot arm 360. The pivot arm 360 connects the front pinch roller to the left pivot hand 364. The left hand is connected to the tower in a manner that enables the left pivot hand 364 to pivot. Thus, the pivot hand connection 1310 to the tower is the pivot point around which the pivot arm 360 swivels. As depicted, the left pivot hand 364 is much longer than needed to connect the pivot arm 360 and the pivot hand connection 1310. The point where the pivot arm 360 connects to the pivot hand is the connection point for the pivot hand 364. The point where the pivot hand 364 is connected to the side 111 is the pivot point for the pivot hand. The additional length greatly magnifies the amount of the pivoting performed by the pivot arm 360. Obviously, the greater the magnitude of the distance between a sensing point 1325 for the rest position and a sensing point 1325' for the fully extended pivot position from the deflection of an insert, the easier it will be to determine the amount of deflection. Therefore, the double detection sensor 1220 detects the magnitude of the pivot at a sensing point 1325', 1325" near the end of the extension of the left pivot hand. The sensor measures the distance from a fixed position within the tower 100 and either sensing point 1325', 1325" corresponding to the deflection caused by one or two inserts.

The double detection sensor 1220 is designed to detect if the suction cup 148 grabbed more than one insert. The double detection sensor 1220 is a commercially available fiber optic array. The double detection sensor 1220 emits a light source and detects the amount of reflected light. The double detection sensor 1220 can measure small distances with tremendous accuracy. The double detection sensor 1220 is connected to a fiber optic module 1222 by fiber optic cable 1324. The fiber optic module 1222, such as the KEYENCE brand module, is commercially available. The fiber optic module 1222 measures the amount of reflected light and transmits a corresponding digital signal to the PLC. The PLC determines from the digital signal the amount of defection of the left pivot hand. Comparing the digital signal to a known value for the distance to the sensing point for the deflection of a single insert 1325', the PLC can determine if more than one insert was pulled. If more than one insert was pulled, the deflection of the pivot hand 364 will be greater than the deflection for just one insert. If the PLC determines that more than one insert was pulled, the PLC sends a fault signal to the inserter computer, which halts the insert process.

Figure 14:
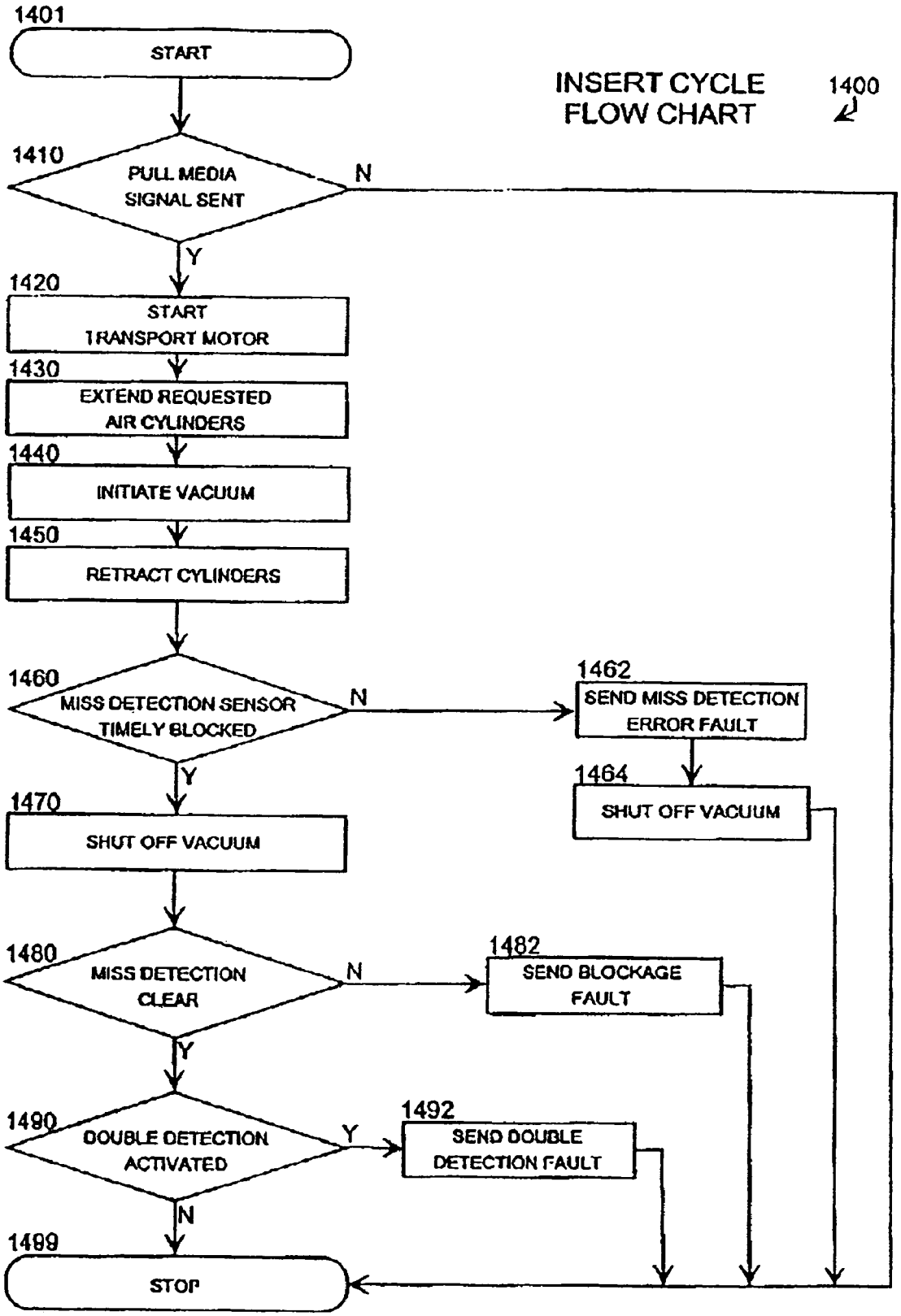
FIG. 14 is a flow chart illustrating an insert cycle.

FIG. 14 is a flow chart illustrating an insert cycle 1400. The insert cycle initiates with start step 1401. The start step 1401 is followed by step 1410, in which a programmable logic controller (PLC determines if the inserter computer sent a media pull signal. The PLC controls the operation of the valves and the relays associated with a vertical insert tower. The inserter computer is the system computer that controls the system timing of the multiple insert delivery system and supplies signals to each PLC specifying which inserts are to be pulled for any given envelope. As part of the initiation of a pull cycle, a sequencer reads a bar code associated with a mailing or bill to be processed. The bar code contains data that includes which inserts are to be associated with the bill. Once the inserter computer has determined which inserts need to be included with a particular bill, the inserter computer informs applicable PLC. If no media pull signal is sent, step 1410 follows the no branch to a step 1499, in which the pull cycle is concluded.

If a pull signal is sent, step 1410 follows the yes branch to step 1420, in which the transport motor is started. A transport motor provides the impetus to operate the belts in a vertical insert tower. Once started, the transport motor is typically not shut off between insert cycles. Step 1420 is followed by step 1430, in which air pressure is applied to the requested air cylinders. The air cylinders extend a cylinder rod that connects to a vacuum tube. At the maximum extension, the suction cup attached to the vacuum tube contacts the first sheet of insert material. Step 1430 is followed by step 1440, in which the vacuum is applied to the requested suction tubes. The vacuum enables the suction cup to grab the first insert. As the suction cup attempts to pull an insert, the air jets provide compressed air to the base of the first sheet in order to separate the first sheet from the material queue. Step 1440 is followed by step 1450, in which the vacuum tube is retracted. The retraction of the vacuum tube pulls an insert to the transport belt.

Step 1450 is followed by step 1460, in which the miss detection sensor determines if an insert has been pulled. A miss detection sensor will monitor each insert station that has been requested to pull an insert. If a requested insert has not been pulled, the NO branch of step 1460 is followed to step 1462. In step 1462, the miss detection provides the PLC with an error fault. Step 1462 is followed by step 1464, in which the vacuum is turned off. After the vacuum is released, the PLC alerts the inserter computer of the fault. Step 1464 is followed by step 1499, in which the process is stopped.

If a requested insert has been pulled, the YES branch of step 1460 is followed to step 1470. In step 1470, the vacuum is shut off to the vacuum tube. The release of the vacuum drops the insert into the first set of pinch rollers. Step 1470 is followed by step 1480, in which the miss detection sensor determines if the material is clear of the miss detection sensor. If the insert jams and does not proceed to traverse the transport mechanism, the miss detection sensor will still detect the presence of the insert material. If the miss detection sensor detects the insert material, the NO branch of step 1480 is followed to step 1482. In step 1482, the miss detection sensor provides the PLC with data indicating a blockage fault. The PLC then sends a fault signal to the inserter computer. Step 1482 is followed by step 1499, in which the process is stopped.

If the miss detection sensor does not detect the insert material, the YES branch of step 1480 is followed to step 1490. In step 1490, the double detection sensor determines if multiple inserts were pulled by the suction cup. If the double detection sensor detects the presence of multiple inserts, the YES branch of step 1490 is followed to step 1492. In step 1492, the double detection sensor generates a fault signal. Step 1492 is followed by step 1499, in which the process is stopped. If the double detection sensor does not detect the presence of multiple inserts, the NO branch of step 1490 is followed to step 1499. In step 1499, an insert cycle is completed.

Figure 15:
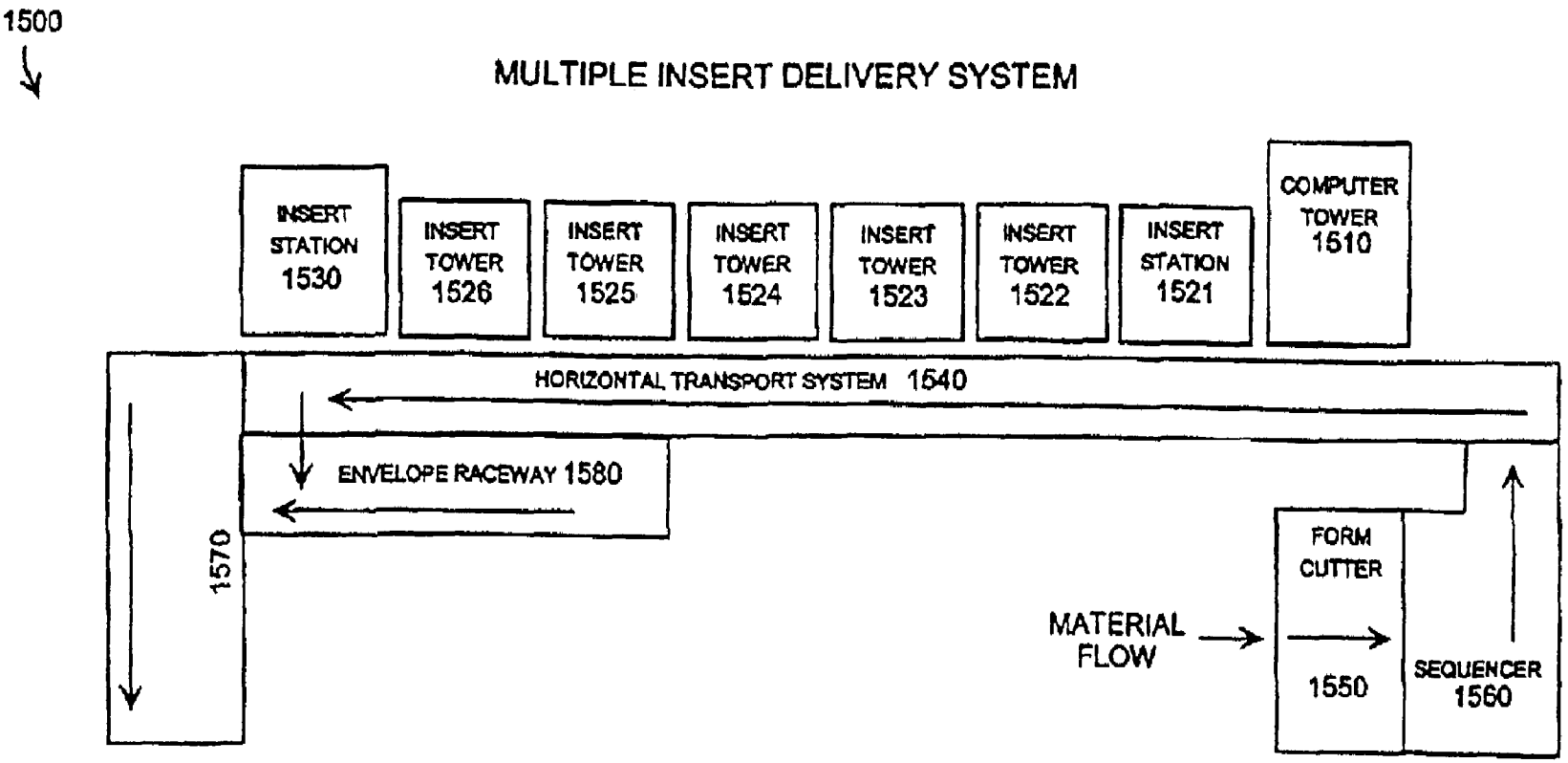
FIG. 15 is a schematic diagram illustrating a multiple insert delivery system.

FIG. 15 depicts a multiple insert delivery system 1500. The multiple insert delivery system illustrated has capability to provide up to 30 different inserts. The system can deliver targeted inserts in the foot stamp of system that previously could deliver only six different inserts. The process begins with a stack of continuous feed paper with mailings or bills printed on the paper. The stack of continuous feed papers is fed into a form cutter 1550. The form cutter 1550 cuts each bill to the proper size to be later enclosed in a mailing envelope. Form cutters are commercially available such as the LAURENTI FORM CUTTER. The form cutter delivers the bill to a sequencer 1560. Sequencers are commercially available such as the ELECTRO MECHANICS CORD MAXIMIZER TURNOVER SEQUENCER. The sequencer reads a bar code and provides the data to the computer tower 1510. The data provided by the bar code provides the information for determining which inserts that should be associated with that particular bill. The computer tower 1510 houses the inserter computer. The inserter computer provides the system timing and instructs each insert tower as to when each insert should be delivered. The sequencer delivers the bill to a horizontal transport system, a raceway 1540. The horizontal transport system 1540 transports the bill to the various insert towers.

As a bill travels along the raceway, the first insert tower 1521 will deliver on top of the bill the inserts associated with that bill stored in that tower. The inserter computer will instruct the insert tower as to which inserts are to be associated with a particular bill. Likewise, the second insert tower 1522 will deliver on top on the new insert stack any associated inserts stored in the second tower. Similarly, the third 1523, fourth 1524, and fifth 1525 insert towers will deliver the appropriate inserts for that bill on top of the insert stack as the bill passes in front of that tower. As the bill and insert stack passes in front of the sixth insert tower 1526, the last of the inserts associated with that bill are placed on top of the insert stack. At the insert station 1530, the insert stack is pushed into an envelope that is travelling along envelope raceway 1580 next to the horizontal transport system 1540. The envelope is sealed and delivered onto the stuffed envelope conveyor 1570 for mailing.

Figure 16:
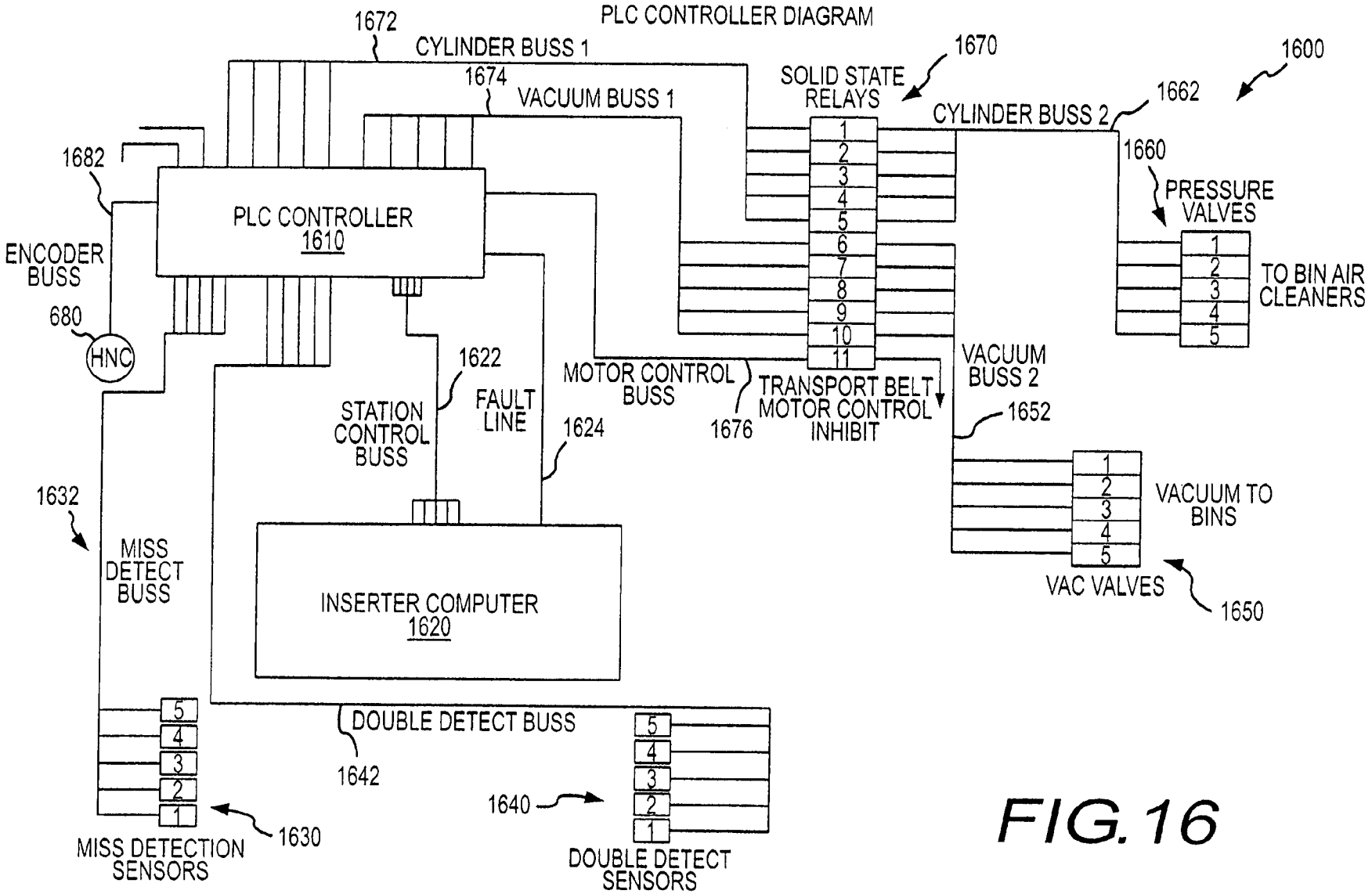
FIG. 16 is a schematic diagram illustrating a PLC controller diagram.

FIG. 16 depicts the PLC controller diagram 1600. The programmable logic controller (PLC) 1610 controls the operation of the relays associated with the vertical insert tower. The inserter computer 1620 determines which inserts, if any, that a vertical insert tower should deliver as the bill passes in front of the tower. At the appropriate time, the inserter computer instructs the PLC to deliver the appropriate inserts during that feed cycle of a tower. A station control buss 1622 carries the signals for the five insert stations in a vertical insert tower. If any of the five insert stations are to process and deliver an insert, the appropriate signal is sent along the station control buss 1622.

At the beginning of a pull cycle, the PLC ensures that the transport motor is operating. The transport motor provides the impetus to turn the various belts in the vertical insert tower. In the process to provide power to the motor, the PLC sends a signal via the motor control buss 1676 that renders solid state relay 11 of the solid state relays 1670 conductive. Next, the PLC initiates extension of the appropriate air cylinders. For the requested insert stations, the PLC 1610 provides the appropriate solid state relays 1-5 of the solid state relays 1670 with a signal via the 1 cylinder buss 1672. The activated solid state relays 1-5 provide the impetus via the 2-cylinder buss 1662 to place the appropriate pressure valves 1660 in a position to supply compressed air to the corresponding air cylinders. The pressure valves 1660 will allow air pressure from a compressor to enter the extension chambers of the selected air cylinders, which extends the corresponding vacuum tubes into a position where a suction cup can make contact with the requested inserts. Additionally, the pressure valves 1650 in this position provide a bleed for the air in the retraction chambers. Furthermore, the tubing for each air cylinder has preferably a splitter (not illustrated) in the line that will also enable the provision of compressed to the air jets for the selected insert stations. The air jets provide air to the base of the front insert to shake the front insert loose from the queue. After the vacuum tubes are extended, the PLC 1610 initiates the vacuum for the selected pulling mechanisms.

The vacuum signal is sent to the appropriate solid state relay 6-10 of the solid state relays 1670 via the 1 vacuum buss 1674. The selected solid state relays 6-10 provide the impetus via the 2 vacuum buss 1652 to actuate the selected vac valves 1650. The actuated vac valves 1650 allow a vacuum to be applied to each selected vacuum tube. The vacuum enables a suction cup at the end of each vacuum tube to grab an insert. After the insert is grabbed, the air cylinders retract the vacuum tubes so that the insert can enter the transport mechanism. The PLC 1610 initiates the retraction of the selected vacuum tubes by sending a signal via the 1 cylinder buss 1672 to the corresponding solid state relays 1-5 of the solid state relays 1670. The actuated solid state relays 1-5 provide the impetus via the 2 cylinder buss 1662 to place the appropriate pressure valves 1660 in a position to supply compressed air to the retraction chamber of an air cylinder. Now, the pressure valves 1660 will allow air pressure from a compressor to enter the selected retraction chambers, which causes the retraction of the inserts until contact is made with the transport belt. The pressure valves 1650 in this position also provides a bleed for the air in the extension chambers.

Upon an insert reaching the transport belt, miss detection sensors 1630 will determine if inserts were successfully grabbed. Each insert station has a corresponding miss detection sensor 1630. Each selected miss detection sensor supplies the PLC 1610 with a signal via the miss detect buss 1632 indicative of whether insert material is detected. If one of the selected miss detection sensors did not detect the presence of insert material, the PLC 1610 generates a fault signal. The fault signal is sent to the inserter computer 1620 via the fault line 1624. Upon receiving a fault signal, the inserter computer 1620 stops the insert process. After the provision of the miss detect signals, the PLC 1610 shuts off the vacuum to the pulling mechanisms. The vacuum off signal is sent to the appropriate solid state relay 6-10 of the solid state relays 1670 via the 1 vacuum buss 1674. The selected solid state relays 6-10 provide the impetus via the 2 vacuum buss 1652 to close the selected vac valves 1650. The closure of the vac valves 1650 shuts off the vacuum applied to each selected vacuum tube. Upon release of the vacuum, the transport belt propels the inserts down the transport mechanism. At this time, the miss detection sensors 1630 sense whether the insert material is still present. If the material is still in front of the sensing mechanism, the insert material has jammed. The miss detection sensors 1630 provide the PLC 1610 with the current insert status via the miss detect buss 1632. If a jam is detected, the PLC notifies the inserter computer 1620 via the fault line 1624. Upon receiving a fault signal, the inserter computer 1620 discontinues the insert process.

After the inserts are released, the transport belt propels each insert into a first set of front pinch rollers. As the inserts pass through the front pinch rollers, the double detection sensors senses whether more than one insert has been pulled. The double detection sensors input signals 1640 provide the PLC 1610 with a signal indicating if any pulling mechanism grabbed multiple inserts. If more than one insert has been pulled by a pulling mechanism, the PLC 1610 send a fault signal via the fault line 1624 to the inserter computer 1620. If the inserter computer 1620 receives a fault signal, the insert process is stopped. Upon the completion of a successful feed cycle, the encoder 1680 provides the PLC 1610 via the encoder buss 1682 with a signal indicating the completion. The PLC 1610 is now reset to start a new feed cycle.

Conveniently, PLC 1610 or another PLC may be interfaced with an I/O board to permit multiple inputs and outputs. Further, such an I/O board may include both analog and digital inputs and/or outputs. In this way, analog signals from various sensors may be directly input into the I/O board and supplied to the controller. One example of such a PLC and I/O board is described in copending U.S. Provisional Application No. 60/368,504, filed Mar. 29, 2002 entitled PLC I/O System for Processing Mail, the complete disclosure of which is herein incorporated by reference.

FIGS. 17-24 illustrate another embodiment of a delivery system 2000. Delivery system 2000 comprises a vertical or tower section 2002 (see FIGS. 17-22), a transition section 2004 and a bottom section 2006 (see FIGS. 23 and 24). Delivery system 2000 operates to deliver sheet-like materials from hoppers 2008 (see FIG. 17) to a conveyor 2010 (see FIG. 24) in a manner similar to that described with previous embodiments. For example, the sheet-like materials are moved from the hoppers to the vertical section 2002 where they are moved downward to transition section 2004 and then to bottom section 2006 where they are deposited onto conveyor 2010. Conveniently, a controller, such as a PLC, may be used to coordinate the various components of delivery system 2000 in a manner similar to that described with other embodiments.

The manner in which sheet-like materials 2012 are removed from their respective hoppers for transport along the remainder of the delivery system is illustrated in FIGS. 17-20. In describing this process, FIGS. 17-20 illustrate a single hopper 2008 and the associated equipment needed to remove a sheet-like material 2012 from hopper 2008. However, it will be appreciated that delivery system 2000 includes multiple hoppers 2008 and associated equipment that are vertically spaced apart from each other in a manner similar to that described with other embodiments. For convenience of discussion, only a portion of vertical section 2002 is shown, with the understanding that a similar process will simultaneously occur in association with each of the vertically spaced hoppers.

Figure 17:
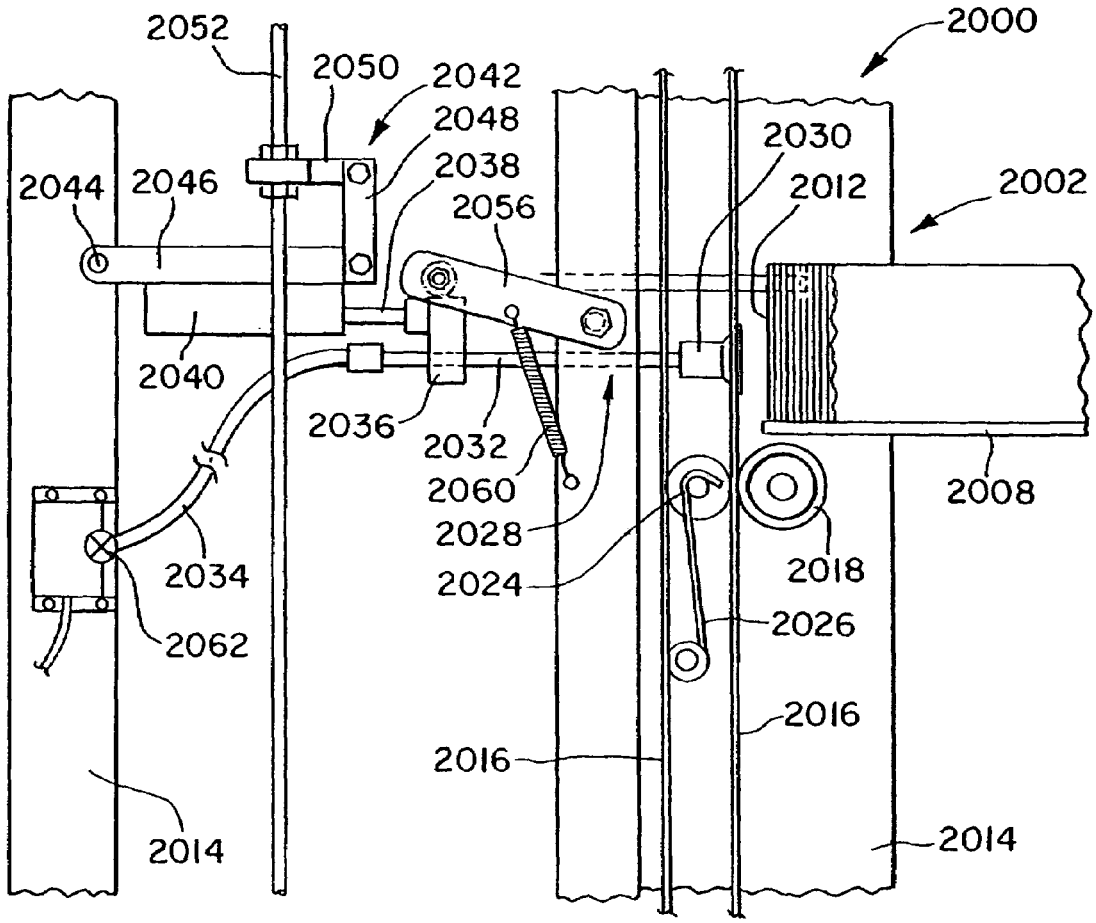
FIG. 17 is a diagrammatic illustration of a side view of an upper section of a delivery system according to another embodiment of the invention.

Beginning with FIG. 17, delivery system 2000 is further constructed of a frame 2014 to which hopper 2008 is coupled. Conveniently, hopper 2008 may be configured in a manner similar to the other hoppers described herein. Hopper 2008 is spaced apart from a pair of upper belts 2016 (see also FIG. 21) that continuously rotate in a clockwise direction when in operation to move sheet-like materials 2012 downward to transition section 2004 (see FIG. 23). Positioned adjacent each upper belt 2016 is a contact roller 2018 that is fixedly attached to frame 2014 using an axle 2020 and a mount 2022 (see FIG. 22). Disposed on the back side of upper belt 2016 are biasing rollers 2024 that are spring biased against upper belts 2016 and contact rollers 2018 by springs 2026. Contact rollers 2018 and biasing rollers 2024 function together as pinch rollers to permit a sheet-like material 2012 to be pinched between contact roller 2018 and upper belt 2016 to facilitate movement of the sheet-like material 2012 downward along belt 2016.

To remove sheet-like materials 2012 from hopper 2008, delivery system 2000 includes a suction apparatus 2028. Such an apparatus 2028 comprises a set of suction cups 2030 (see also FIG. 21) that are connected to lengths of tubing 2032. Tubing 2032 may be constructed of a rigid material, such as copper or aluminum and is attached to flexible tubing 2034. In turn, flexible tubing 2034 is coupled to a vacuum system (not shown) to provide suction to suction cups 2030. Lengths of tubing 2032 are coupled to a block 2036 so that suction cups 2030 may simultaneously be moved back and forth by moving block 2036.

To move block 2036 forward and backward, delivery system 2000 utilizes an air cylinder 2038 that is coupled to block 2036. Conveniently, portions of air cylinder 2038 may be held within a housing 2040. Air cylinder 2038 may include a pair of chambers that are alternatively filled and evacuated with air to extend and retract the air cylinder. Although shown as an air cylinder, it will be appreciated that other mechanisms may be used, such as a solenoid. Housing 2040 is coupled to a linkage arrangement 2042 that in turn is pivotally coupled to frame 2014 at a pivot point 2044. Linkage arrangement 2042 comprises three arms 2046, 2048 and 2050. Arm 2046 is coupled to housing 2040 while arm 2050 is coupled to a rod 2052. In turn rod 2052 is coupled to other linkage arrangements that are associated with other hoppers of delivery system 2000. Further, although not shown, an air cylinder arrangement similar to air cylinder 2038 is also coupled to rod 2052 to move rod 2052 up and down. By moving rod 2052 downward, linkage arrangement 2042 pivots about pivot point 2044 causing suction cups 2030 to move downward. Conversely, when rod 2052 is moved upward, linkage arrangement 2042 pivots upwardly about pivot point 2044 to move suction cups 2030 upward. Hence, by using rod 2052, the suction cups that are associated with each hopper are simultaneously moved upward and downward by the same distance and in the same manner.

A cycle for removing a sheet-like material 2012 from hopper 2008 and delivering the sheet-like material 2012 to belt 2016 is illustrated in FIGS. 17-20. FIG. 17, suction cups 2030 are in a starting position where they are spaced apart from sheet-like materials 2012. In FIG. 17, air cylinder 2038 has just begun to move block 2036 forward so that suction cups 2030 have moved from behind belt 2016 to a position in front of belt 2016 where they will continue moving forward toward sheet-like materials 2012. Initially, suction cups 2030 are maintained behind belt 2016 so that they do not interfere with any sheet-like materials being moved downward from belt 2016 during a previous cycle.

Figure 18:
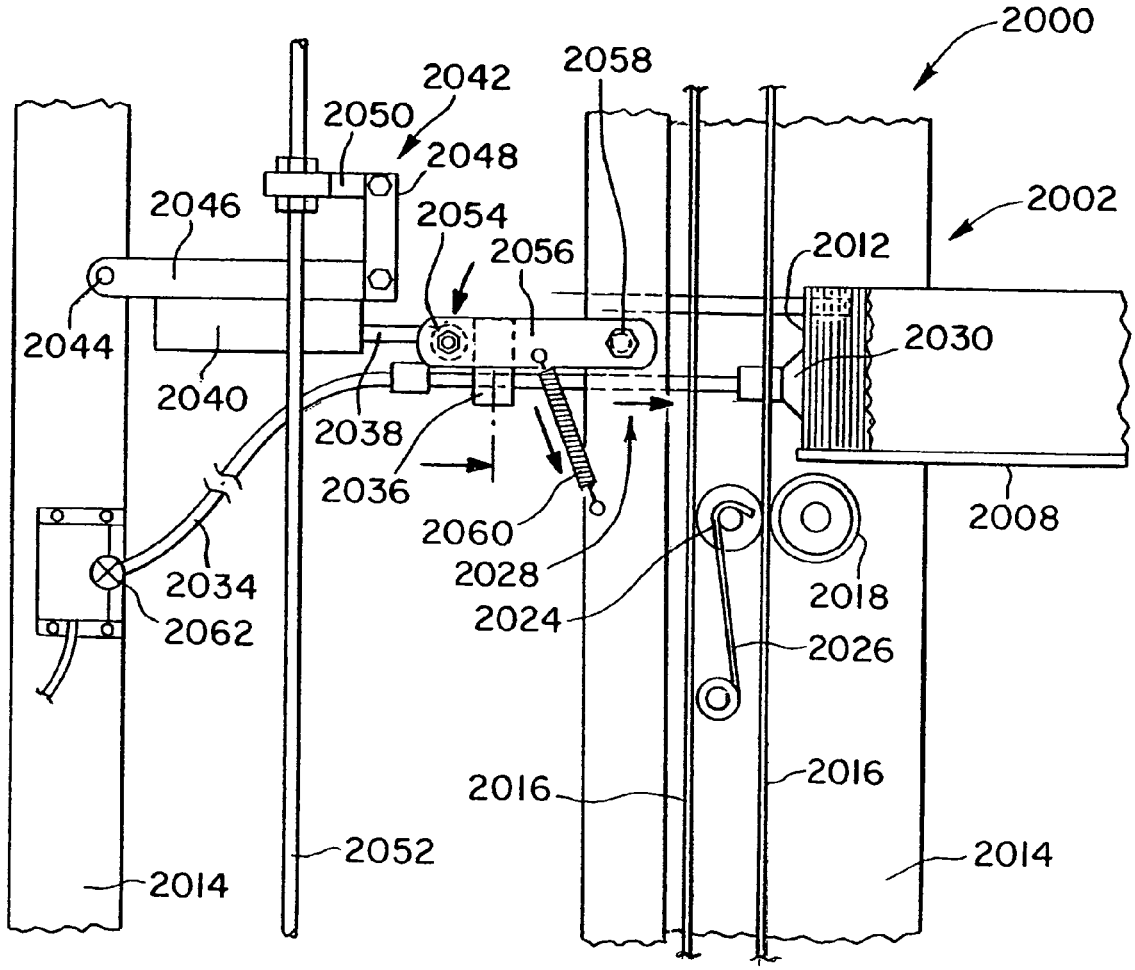
FIG. 18 illustrates the delivery system of FIG. 17 when a suction apparatus has moved forward to grasp a sheet-like material from a hopper.

In FIG. 18, air cylinder 2038 has moved block 2036 forward so that suction cups 2030 are now in contact with the end most sheet-like material 2012. Suction is applied through lengths of tubing 2034 and 2032 so that vacuum cups 2030 grab sheet-like material 2012 when placed into contact with sheet-like material 2012. Once sheet-like materials 2012 has been grasped by suction cups 2030, air cylinder 2038 is retracted so that the grasped sheet-like material may be removed from hopper 2008. Preferably, air cylinder 2038 is retracted enough to remove sheet-like material 2012 from hopper 2008 while also keeping sheet-like material 2012 in front of belt 2016. This is facilitated by use of roller 2054 which acts as a stop to prevent further backward movement of suction cups 2030 as air cylinder 2038 is retracted. More specifically, as shown in FIG. 17, as block 2036 is moved forward, a roller 2054 on a pivot arm 2056 moves from a position on top of block 2036 to a position behind block 2036 (see FIG. 18). Arm 2056 is pivotally coupled to frame 2014 at a pivot point 2058 to permit arm 2056 to pivot relative to frame 2014. A spring 2060 facilitates pivoting of arm 2056 downward so that roller 2054 is behind block 2036.

As shown in FIG. 18, a small gap is provided between roller 2054 and block 2036 when suction cups 2030 are fully extended to grasp sheet-like material 2012. Once air cylinder 2038 is retracted, block 2036 will contact roller 2054 to prevent further backward movement so that sheet-like material 2012 remains in front of belt 2016.

Figure 19:
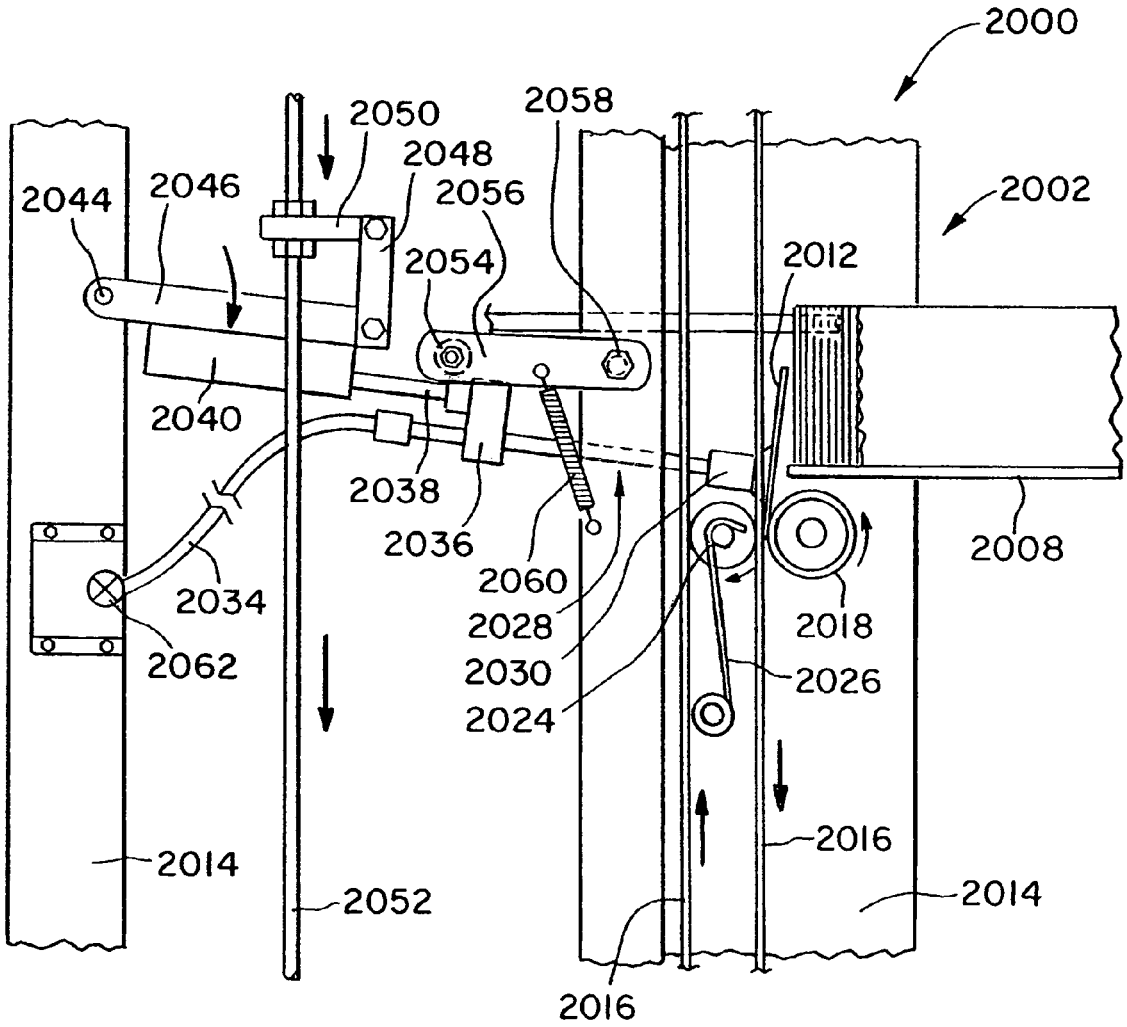
FIG. 19 illustrates the delivery system of FIG. 17 when the suction apparatus has moved downward to deliver the grasped sheet-like material to an upper belt.

As shown in FIG. 19, rod 2052 is moved downward to pivot arm 2046 about pivot point 2044. In turn, suction cups 2030 are moved downward until sheet-like material 2012 is grabbed between rollers 2018 and belts 2016. In this way, the removed sheet-like materials from each hopper are delivered to belt 2016 at the same time where they are pulled from suction cups 2030 and moved downwardly along belts 2016. In this manner, a consistent spacing is maintained between the sheet-like materials that have simultaneously been removed from each of hoppers 2008.

Figure 20:
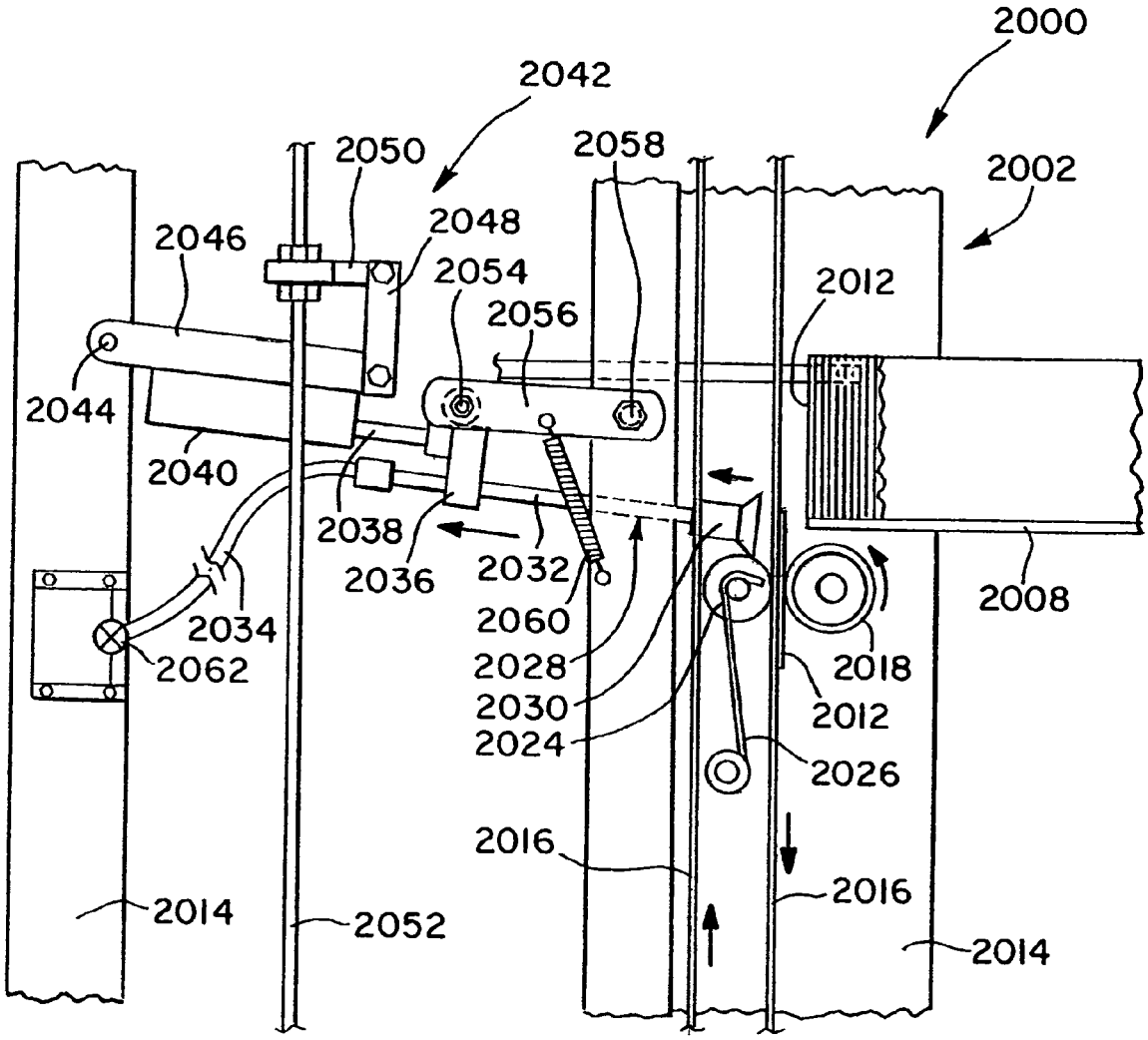
FIG. 20 illustrates the delivery system of FIG. 17 when the sheet-like material has been grabbed between the upper belt and a contact roller and the suction apparatus has been retracted.

Once sheet-like material 2012 has been removed from suction cups 2030, the vacuum may be stopped and air cylinder 2038 may be retracted as shown in FIG. 20. In so doing, suction cups 2030 are moved back behind belts 2016 so they do not interfere with the movement of sheet-like materials from other hoppers that are passing downward along belt 2016. Rod 2052 is also moved upward so that suction cups 2030 may return their original position. Further, when block 2036 is fully retracted, roller 2054 pops back on top of block 2036 so that it rests on top of block 2036 as shown in FIG. 17. When in this position, another cycle may begin by repeating the steps illustrated in FIGS. 17-20.

To ensure that a sheet-like material has been removed from each hopper 2008, a pressure transducer 2062 may be placed in communication with each length of tubing 2034. When a sheet-like material 2012 is sectioned onto suction cups 2030, the vacuum within tubing 2034 should increase in magnitude. If not, the controller may determine that a sheet-like material has not been sectioned onto suction cups 2030 and may stop operation so that an insert may be added.

One advantage of placing springs 2026 behind belt 2016 is that they do not interfere with the path of the sheet-like materials 2012 as they pass along belt 2016. In this way, wider sheet-like materials may be used with delivery system 2000. Another feature is that upper belts 2016 have been moved relatively close together to facilitate movement of smaller inserts along belts 2016. Further, such an arrangement permits the use of additional suction and provides a suction cup generally in the center of the sheet-like material to ensure that the sheet-like material is grasped and removed from the hopper. Further, as illustrated in FIG. 17, bins 2008 are positioned relatively close to belt 2016 (such as within about three quarters of an inch) to minimize the length of travel of suction cups 2030.

Figure 21:
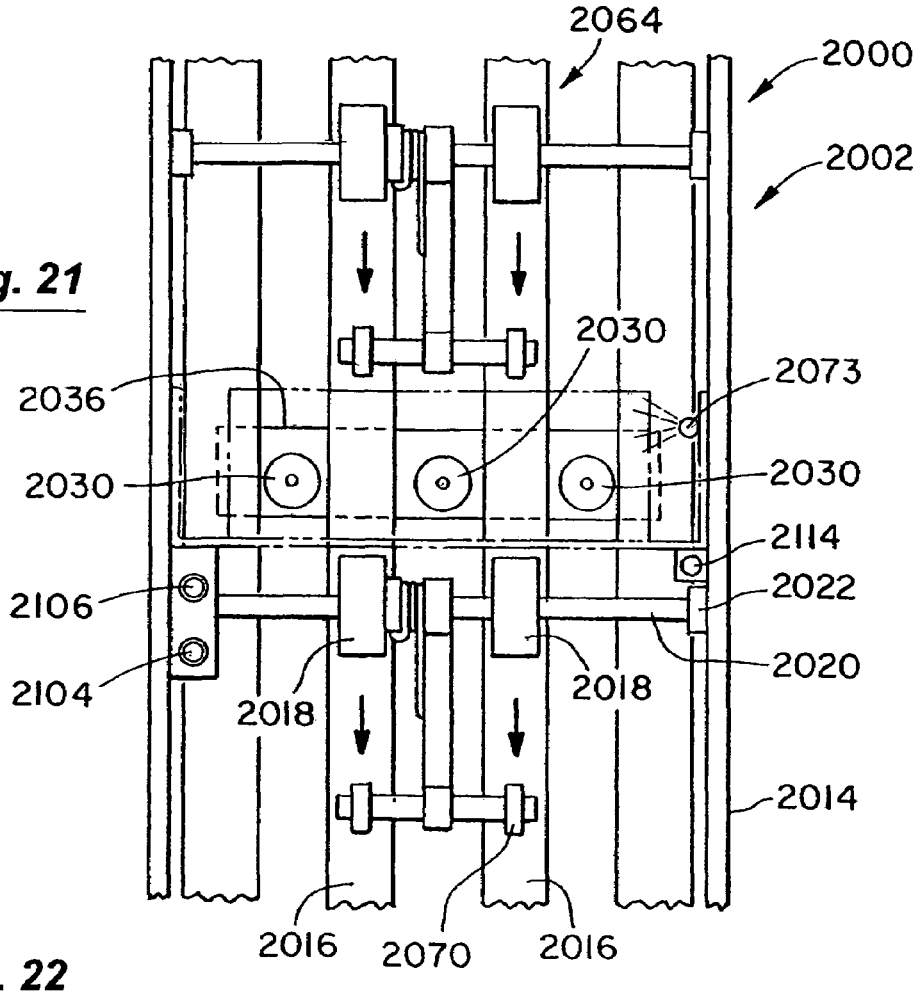
FIG. 21 is a front view of the upper section of the delivery system depicted in FIG. 17.
Figure 22:
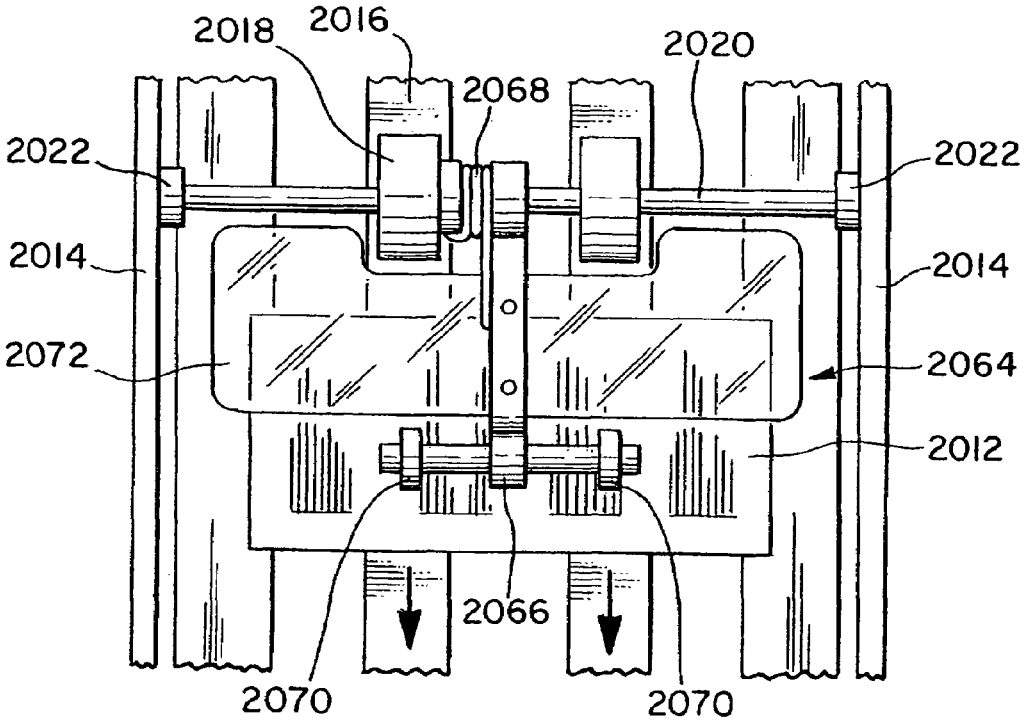
FIG. 22 is a more detailed view of the delivery system of FIG. 21 showing a guide that is used to hold a sheet-like material to the upper belts according to the invention.

As best illustrated in FIGS. 21 and 22, delivery system 2000 further includes a guide system 2064 to maintain pressure on the sheet-like materials as they move downwardly along belts 2016. This constant pressure helps ensure that the sheet-like material will make it to the next contact roller 2018 in its travel downward along vertical section 2002. Guide system 2064 comprises an idler 2066 that is coupled to axle 2020. A spring 2068 biases idler 2066 against belts 2016 so that when a sheet-like material 2012 passes downwardly along belts 2016, it will be held to the belts by idler 2066 as shown in FIG. 22. Conveniently, idler 2066 may include a pair of rollers 2070 to facilitate movement of sheet-like material 2012 between idler 2066 and belts 2016. Guide system 2064 further includes a plate 2072 to further assist in holding sheet-like material 2012 against belts 2016. Conveniently, plate 2072 may be constructed of any rigid material, such as a piece of clear plastic.

As best shown in FIG. 21, vertical section 2002 may include air jets 2073 that are arranged to laterally inject air into the hoppers 2008. The injection of air laterally into hoppers 2008 helps separate the sheet-like materials 2012 so that only a single sheet-like material is removed from each hopper during each cycle.

Figure 23:
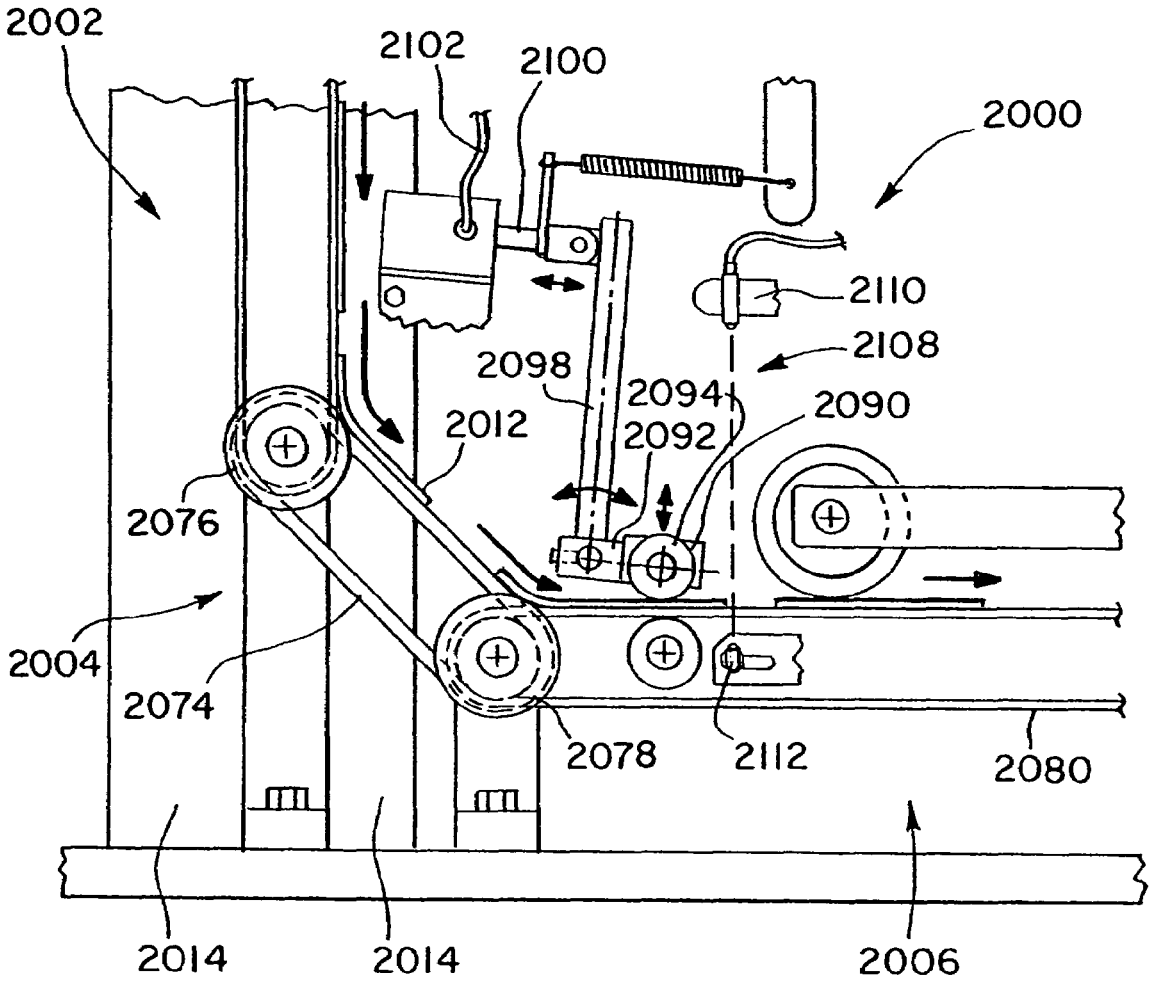
FIG. 23 is a diagrammatic illustration depicting a side view of a bottom section and a transition section that is coupled to the upper section of the delivery system of FIG. 17.
Figure 24:
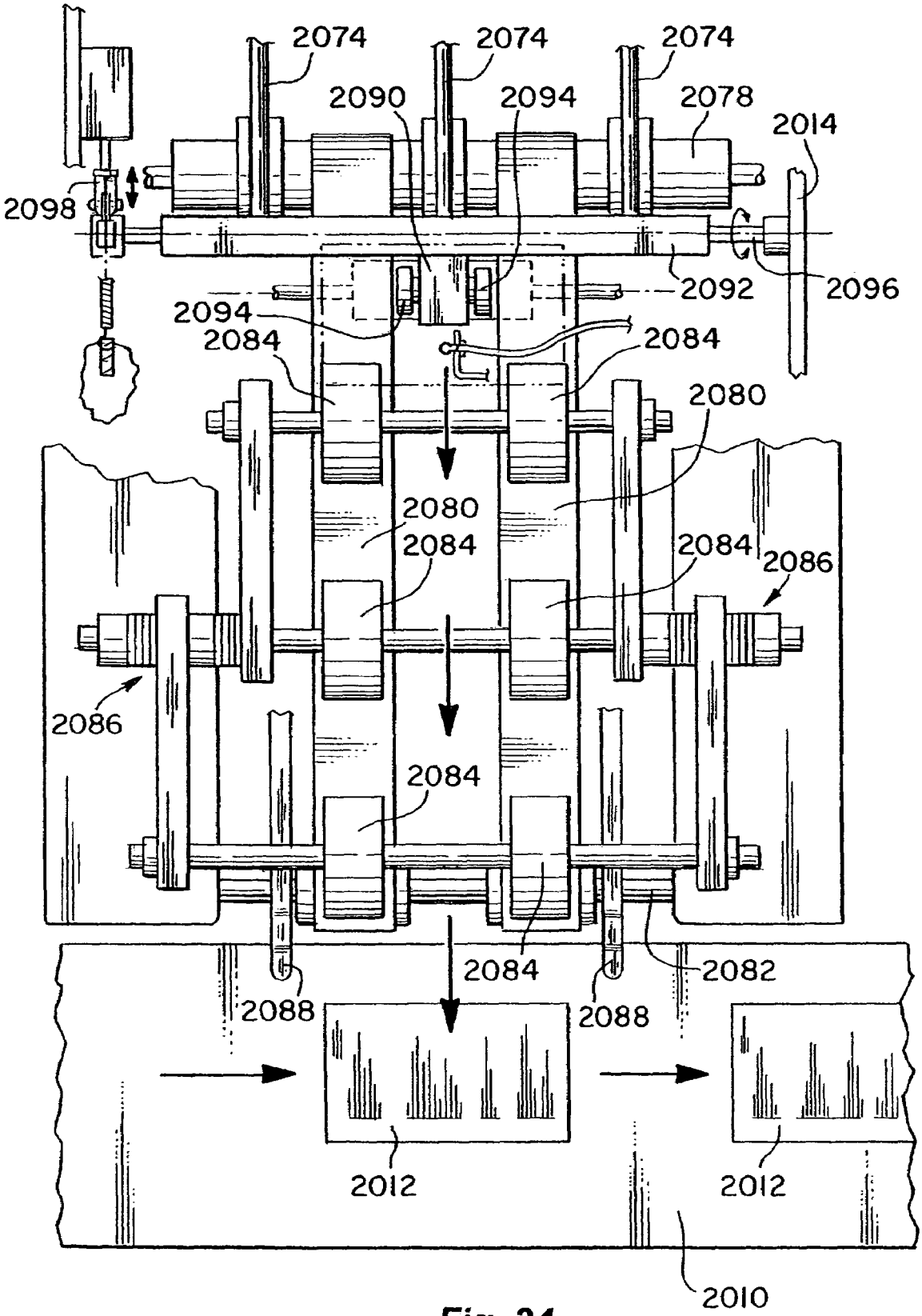
FIG. 24 illustrates a top view of the transition section and bottom section of the delivery system of FIG. 23 and further illustrating the delivery of a sheet-like material onto a conveyor according to the invention.

Referring now to FIGS. 23 and 24, construction of transition section 2004 and bottom section 2006 will be described in greater detail. As sheet-like material 2012 passes downwardly along belts 2016, it reaches transition section 2004 where it engages three o-rings 2074 that move sheet-like material 2012 away from belts 2016 to transition its movement to bottom section 2006. The use of three o-rings 2074 provides additional contact with sheet-like material 2012 to facilitate its movement along transition section 2004 and into bottom section 2006. A pair of rollers 2076 and 2078 are employed to rotate o-rings 2074.

Bottom section 2006 comprises a pair of lower belts 2080 that receives sheet-like materials 2012 from o-rings 2074. Lower belts 2080 are rotated using roller 2078 and a roller 2082. Suspended above lower belts 2080 are six rollers 2084. Each roller 2084 is independently suspended using a suspension system 2086 that utilizes tension springs to permit independent movement of each of rollers 2084. By independently suspending each roller 2084, less vibration is provided to the sheet-like materials 2012 so that the sheet-like materials flow straight along lower belts 2080 and are deposited at a consistent location along conveyor 2010. Conveniently, a pair of arms 2088 are provided at the end of lower belts 2080 and serve to channel the sheet-like materials downward onto conveyor 2010. In this way, when a set of sheet-like materials have been removed from hoppers 2008 and are flowing from lower belts 2080 onto conveyor 2010, they will be deposited one on top of each other in a consistent manner.

Delivery system 2000 further includes a thickness tester to determine whether multiple sheet-like materials have been pulled from the same hopper during a single cycle. The thickness tester comprises an idler 2090 that is coupled to a bar 2092. Idler 2090 includes a set of rollers 2094 that permit sheet-like materials 2012 to flow along lower belts 2080 while still contacting idler 2090 as illustrated in FIG. 23. Beneath rollers 2094 are rollers 2095 that are fixed in placed so that they do not move up and down. Bar 2092 is coupled to an axle 2096 that in turn is rotatably coupled to frame 2014. Fixedly mounted to axle 2096 is an arm 2098 that pivots backward and forward as sheet-like materials 2012 move between rollers 2094 and lower belts 2080 as illustrated by the arrows in FIGS. 23 and 24. Arm 2098 is coupled at its opposite end to a potentiometer 2100. In turn, potentiometer 2100 is electrically coupled to the controller by wiring 2102. As arm 2098 moves backward and forward, potentiometer 2100 produces an electrical signal that is transmitted to the controller. Based on the signal generated by potentiometer 2100, the thickness of the sheet-like materials disposed between rollers 2094 and lower belts 2080 may be determined. Hence, by calibrating the system when one sheet-like material is disposed beneath rollers 2094, a determination may be made as to whether additional sheet-like materials are stacked on top of each other when passing beneath rollers 2094 based on whether the calibrated signal level is exceeded.

To calibrate of the system, a set button 2104 (see FIG. 21) may be pushed when a single sheet-like material 2012 is beneath rollers 2094. To facilitate calibration, a dispense button 2106 (see FIG. 21) may be pushed to dispense a single sheet-like material through delivery system 2000 until it reaches rollers 2094.

Delivery system 2000 may further include a counter 2108 that counts the number of sheet-like materials delivered by delivery system 2000. Counter 2108 may conveniently comprise a light emitting element 2110 and a light sensor 2112. Light emitting element 2110 transmits a beam of light that passes between lower belts 2080 and impinges upon sensor 2112. When a sheet-like material 2012 breaks this beam of light, sensor 2112 detects this and sends a signal to the controller which counts the sheet-like materials. Further, counter 2108 may be used as a trigger to indicate to the controller that it is time to take a thickness measurement since the beam of light is broken as a sheet-like material passes beneath rollers 2094.

Referring back to FIG. 21, delivery system 2002 may further include an adjust knob 2114 that may be turned to adjust the amount of vacuum supplied to suction cups 2030. In this way, a user may easily adjust the vacuum simply by turning knob 2114.

In view of the foregoing, it will be appreciated that the invention provides a multiple insert delivery system consisting of new vertical insert towers. It should be understood that the foregoing relates only to the exemplary embodiments of the present invention, and that numerous changes may be made therein without departing from the spirit and scope of the invention as defined by the following claims. Accordingly, it is the claims set forth below, and not merely the foregoing illustration, which are intended to define the exclusive rights of the invention.

What is claimed is:

1. A sheet-like material detection system comprising:

a frame;

a plurality of hoppers operably coupled to the frame, wherein the hoppers are positioned in a vertically spaced apart arrangement, wherein the hoppers are each configured to hold sheet-like materials;

at least one belt that is configured to move sheet-like materials after their removal from the hoppers;

at least one roller disposed over the belt that is configured to roll over a sheet-like material moved by the belt, wherein the roller is rotatably coupled to a first axle, wherein the first axle is coupled to a shaft that is coupled to second axle that is pivotally coupled to the frame, wherein the first and second axles are spaced apart by the shaft;

an arm that is coupled to the second axle such that when a sheet-like material passes beneath the roller, both the shaft and the arm pivot about the second axle;

a potentiometer in contact with the arm, wherein the potentiometer is configured to produce an electrical signal that is related to the amount of movement of the arm that is turn is related to the amount of movement of the roller when one or more sheet-like materials is beneath the roller.

2. A system as in claim 1, further comprising a trigger sensor that is configured to sense when a sheet-like material is beneath the roller.

3. A system as in claim 2, further comprising a controller that is configured to receive a signal from the trigger sensor indicating that a sheet-like material is beneath the roller and to record a signal from the potentiometer up receive of the signal from the trigger sensor.

4. A method for detecting how many sheet-like materials are stacked together, the method comprising:

providing a plurality of hoppers in a vertically spaced apart orientation, wherein the hoppers include sheet-like materials;

moving one or more of the sheet-like materials from the hoppers and onto a belt;

moving one or more of the sheet-like materials along the belt until the sheet-like material passes beneath a roller, wherein the roller is rotatably coupled to a first axle, wherein the first axle is coupled to a shaft that is coupled to second axle that is pivotally coupled to a frame, wherein the first and second axles are spaced apart by the shaft, and wherein an arm is coupled to the second axle such that when a sheet-like material passes beneath the roller, both the shaft and the arm pivot about the second axle; and detecting the amount of movement of the arm to determine the number of sheet-like materials beneath the roller.

5. A method as in claim 4, wherein the detecting step comprises permitting the arm to move against a potentiometer to produce an electrical signal that is related to the amount of movement of the arm.

6. A method as in claim 5, further comprising placing one sheet-like material between the roller and the belt and calibrating the potentiometer.

7. A method as in claim 4, further comprising sensing with a sensor when the sheet-like material is beneath the roller.

* * * * *